US011447986B2

(12) United States Patent
Ono et al.

(10) Patent No.: US 11,447,986 B2
(45) Date of Patent: Sep. 20, 2022

(54) HANDLE DEVICE FOR VEHICLE

(71) Applicant: ALPHA CORPORATION, Yokohama (JP)

(72) Inventors: Takashi Ono, Yokohama (JP); Masaya Onoda, Yokohama (JP)

(73) Assignee: ALPHA CORPORATION, Kanagawa (JP)

( * ) Notice: Subject to any disclaimer, the term of this patent is extended or adjusted under 35 U.S.C. 154(b) by 1203 days.

(21) Appl. No.: 15/700,223

(22) Filed: Sep. 11, 2017

(65) Prior Publication Data

US 2017/0370131 A1 Dec. 28, 2017

Related U.S. Application Data

(63) Continuation of application No. PCT/JP2016/057853, filed on Mar. 11, 2016.

(30) Foreign Application Priority Data

Mar. 12, 2015 (JP) ..... JP2015-049643

(51) Int. Cl.

| | |
|---|---|
| ***E05B 77/02*** | (2014.01) |
| ***E05B 79/10*** | (2014.01) |
| ***E05B 81/90*** | (2014.01) |
| ***E05B 85/16*** | (2014.01) |

(52) U.S. Cl.

CPC ..... *E05B 79/10* (2013.01); *E05B 77/02* (2013.01); *E05B 81/90* (2013.01); *E05B 85/16* (2013.01)

(58) Field of Classification Search

CPC ..... E05B 79/10; E05B 77/02; E05B 81/90; E05B 85/16

See application file for complete search history.

(56) References Cited

U.S. PATENT DOCUMENTS

| | | | | |
|---|---|---|---|---|
| 8,528,949 | B2 * | 9/2013 | Katsumata | E05B 81/14 292/201 |
| 9,605,452 | B2 * | 3/2017 | Yoshino | E05B 85/107 |
| 9,970,219 | B2 * | 5/2018 | Kouzuma | E05B 85/12 |

(Continued)

FOREIGN PATENT DOCUMENTS

| | | |
|---|---|---|
| CN | A-101418653 | 4/2009 |
| CN | A-101994416 | 3/2011 |

(Continued)

OTHER PUBLICATIONS

JP Office Action dated Aug. 28, 2018 from corresponding Japanese patent application No. 2015-049643 (with attached English-language translation).

(Continued)

*Primary Examiner* — Kristina R Fulton
*Assistant Examiner* — Thomas L Neubauer
(74) *Attorney, Agent, or Firm* — Faegre Drinker Biddle & Reath LLP

(57) ABSTRACT

A handle device for a vehicle in which an operating member linked to a base fixed to a door of a vehicle to be rotatably operable is operated so as to displace an output portion and operate a door lock device in the door linked to the output portion. A displacement amount in the output portion per unit operation angle of the operating member changes according to a rotation position of the operating member.

20 Claims, 18 Drawing Sheets

(56) References Cited

U.S. PATENT DOCUMENTS

| | | | |
|---|---|---|---|
| 2001/0005082 | A1 | 6/2001 | Suparschi |
| 2003/0001396 | A1 | 1/2003 | Jooss et al. |
| 2004/0232710 | A1 | 11/2004 | Jooss et al. |
| 2009/0107194 | A1 | 4/2009 | Tamezane |
| 2010/0230980 | A1 | 9/2010 | Ichikawa et al. |
| 2011/0042973 | A1 | 2/2011 | Yoshino et al. |
| 2011/0101709 | A1 | 5/2011 | Katsumata et al. |
| 2014/0132012 | A1 | 5/2014 | Yoshino et al. |

FOREIGN PATENT DOCUMENTS

| | | | | |
|---|---|---|---|---|
| DE | A1-10131436 | | 1/2003 | |
| GB | 2536671 | * | 9/2016 | ..... E05B 85/00 |
| JP | H06-35091 Y2 | | 9/1994 | |
| JP | H07-4298 Y2 | | 2/1995 | |
| JP | A-H09-096131 | | 4/1997 | |
| JP | 2005-2567 A | | 1/2005 | |
| JP | A-2007-085032 | | 4/2007 | |
| JP | A-2010-209569 | | 9/2010 | |
| JP | 2011-94436 A | | 5/2011 | |
| JP | 4759525 B2 | | 8/2011 | |

OTHER PUBLICATIONS

International Search Report dated Jun. 14, 2016 for PCT/JP2016/057853, including English translation.

Written Opinion dated Jun. 14, 2016 for PCT/JP2016/057853.

JP Office Action dated Jul. 30, 2019 from corresponding Japanese patent application No. 2016-054228 (with attached English-language translation).

CN Office Action dated Dec. 28, 2018 in Chinese Application No. 201680015337.7 (with attached English-language translation).

* cited by examiner

HANDLE DEVICE FOR VEHICLE

CROSS REFERENCE TO RELATED APPLICATIONS

This application is a continuation of PCT application No. PCT/JP2016/057853, which was filed on Mar. 11, 2016 based on Japanese Patent Application (No. 2015-049643) filed on May 12, 2015, the contents of which are incorporated herein by reference.

TECHNICAL FIELD

The present invention relates to a handle device for a vehicle.

BACKGROUND ART

As a handle device which generates a predetermined displacement at an output point by performing a rotation operation with respect to an operating member linked to a base, and operates a door lock device connected to the output point, a device described in PTL 1 (JP-A-2005-2567) is known.

Patent document 1 (JP-A-2005-2567) discloses a handle device formed to link a handle (operating member) to the base to be freely rotatable. When performing a rotation operation with respect to the operating member, a lever is driven to rotate and a door lock device is operated via a wire linked to an output portion of the lever.

However, the handle device disclosed in the patent document 1 has a problem of poor operability and an increase in operating force.

In other words, in the example of the above-described related art, since the distance (arm length) between a rotation center of the lever and a contact portion to an operating portion is substantially constant across the entire process of the operating portion, a rotation angle of the lever per unit rotation angle of the operating member is substantially constant across substantially the entire process.

Meanwhile, at an initial state before a practical releasing operation with respect to a locked part is started, the operating force to the door lock device is small, a necessary operating force to the door lock device becomes the maximum from the start to the end of the releasing operation, and thus, the operating force to the operating member is low at an initial state of the operation, and suddenly increases at a stroke final end at which a lock releasing operation with respect to the door lock device is started, and operability deteriorates.

In addition, when the operating force suddenly increases, a difference in the operating force before the increase and after the increase increases, and thus, it becomes necessary to apply the operating force as much as the difference during a short period of time during which the door lock device is operated, and thus, the operating force becomes relatively large.

Meanwhile, as a handle device for a vehicle that can operate an electric latch driving mechanism and a mechanical latch mechanism which are fixed to a door of a vehicle, a device described in patent document 2 (JP-Y-H6-35091) is known.

The patent document 2 discloses a handle device including a push button which fixes a contactor at a tip end of a leg portion and is mounted on an armrest; and a switch contact point which is short-circuited by the contactor in a state where the push button is pushed down.

The push button and the switch contact point are respectively biased in a jumping direction by a compression spring, and a latch releasing operation is performed as an electric latch driving mechanism is operated by pushing down the push button. In addition, when the push button is further pushed down from the state, it is possible to operate a mechanical latch mechanism via an arm linked to the push button, and to use the mechanical latch mechanism as emergency releasing means when the electric latching driving mechanism is not operated.

However, the handle device disclosed in the patent document 2 has a problem of poor handleability since it is necessary to push the push button under a resistance which is stronger compared to that in a normal state in a case where the electric latch driving mechanism is not operated.

In addition, generally, an opening operation of a door is performed by pushing the door itself or an armrest outward, and is not directly related to an operation of pushing the push button. Therefore, in a case where the electric latch driving mechanism is not operated, there is a problem that it is difficult to remind that the operation of pushing the push button further against the resistance is an operation during the emergency.

[Patent Document 1] JP-A-2005-2567

[Patent Document 2] JP-Y-H6-35091

SUMMARY OF INVENTION

According to the disclosure, in a handle device for a vehicle in which an operating member 3 linked to a base 2 fixed to a door 1 of a vehicle to be rotatably operable is operated so as to displace an output portion 4 and operate a door lock device 5 in the door 1 linked to the output portion 4, a displacement amount in the output portion 4 per unit operation angle of the operating member changes according to a rotation position of the operating member 3.

According to the handle device for the vehicle of the disclosure, an operating force to the operating member 3 is transmitted to the door lock device 5 via the output portion 4. When operating the door lock device 5, a necessary work to finish the operation of the door lock device 5 is uniformly determined by the lever ratio of the operating member 3 or the resistance in operating the door lock device 5.

In addition, according to the handle device for the vehicle of the disclosure, the displacement amount in the output portion 4 with respect to the unit operation rotation angle of the operating member 3 is changed according to the rotation position of the operating member 3, it is possible to freely set a peak position of the operating force to the operating member 3 necessary for operating the door lock device 5 regardless of a lock releasing operation timing at which the resistance on the door lock device 5 side becomes the maximum. As a result, since it is possible to freely set distribution and the peak value of the resistance value (operating force) to the operating member 3, it is possible to achieve design that considers operation feeling, and to improve operability.

In addition, in the handle device for the vehicle of the disclosure, the displacement amount in the output portion 4 per unit operation angle of the operating member 3 may be large at an initial state of a handle operation and may be small in a vicinity of a lock releasing operation position of the door lock device 5.

According to the disclosure, as the displacement amount in the output portion 4 per unit operation angle of the operating member 3 is large at an initial state of the handle operation and is small in the vicinity of the lock releasing operation position of the door lock device 5, it is possible to increase the necessary operating force at an initial state of the operation at which the operation resistance from the door lock device 5 is low, and to decrease the operating force at a later stage at which the resistance from the door lock device 5 increases.

As a result, since it is possible to set the operating force to be substantially equivalent across the entire process, it is possible to improve the operability.

In addition, in the handle device for the vehicle of the disclosure, the output portion 4 may include a cam body 7 including a cam portion 6 which is linked to the base 2, driven to rotate by the operating member 3, and for determining a rotation angle of the operating member 3 and a property of displacement of the output portion 4, and a follower body 8 driven by the cam portion 6, and the door lock device 5 may be operated by the displacement of the follower body 8.

According to the disclosure, by the configuration of adjusting the input and output lever ratio of the entire body by the cam body 7 using the cam body 7, it is possible to simplify the structure of adjusting the displacement amount in the output portion 4 per unit operating angle of the operating member 3. Furthermore, it is possible to respond to the change or the like of the door lock device 5 only by optimizing and changing the cam body 7, and to improve general-purpose properties.

In addition, in the handle device for the vehicle of the disclosure, the cam portion 6 configured of a long hole which is opened in the cam body 7 having a shape of a plate lever and in which a distance from the rotation center of the cam body 7 gradually changes, may be formed. In the follower body 8, a follower pin 9 which moves in the long hole may be provided.

According to the disclosure, it is possible to use various known members as the cam body 7, but as the cam body 7 is configured as a plate cam, it is possible to easily apply a function as a lever which is frequently used in transmitting the operating force to the operating member 3 to the cam body 7, and the structure of the cam body 7 is simplified. In addition, by configuring the cam body 7 as a positive motion cam, followability to the cam portion 6 increases, and the operation reliability is improved.

In addition, the handle device for the vehicle of the disclosure may include a handle unit 10 which links the operating member 3 and the base 2 to each other in advance and is fixed to a front surface of the door 1, and an output portion unit 12 which holds the output portion 4 to a unit base 11 and is fixed to a rear surface of the door panel 1.

According to the disclosure, the handle device for the vehicle is made into a unit including the handle unit 10 fixed to the front surface of the door 1 and the output portion unit 12 fixed to the rear surface of the door panel 1. Only by fixing each of the units to the front and rear surfaces of the door panel 1 and by fixing the output portion unit 12, the fixing work of the handle device to the door 1 is finished, and thus, it is possible to improve fixing workability of the handle device to the door 1.

In addition, in a case of incorporating the output portion 4 into the handle unit 10 fixed to the front surface of the panel, it is necessary to install a large mounting opening to be open for making the output portion 4 to pass through the inside of the door panel 1 on the door panel 1, but by separating the output portion 4 from the handle unit 10, it is possible to reduce the size of the mounting opening installed to be open on the door panel 1. Furthermore, since the output portion 4 is made as a unit, the fixing work of the output portion 4 to the rear surface of the door panel 1 also becomes simple.

In addition, in the handle device for the vehicle of the disclosure, a lever 14 which swings in accordance with the operation of the operating member 3 and in which a linked portion 13 is oriented toward an inside of the door 1, may be disposed in the handle unit 10. A linking portion 15 which is linked to the linked portion 13 of the lever 14 and transmits an operating force to the operating member 3 to the output portion 4, when being fixed to the rear surface of the door panel 1 is provided with the output portion unit 12.

According to the disclosure, since operating force transmitting paths of the output portion unit 12 and the handle unit 10 are connected to each other by the fixing work of the output portion unit 12 to the rear surface of the door panel 1, it is possible to improve the fixing workability of the handle device for the vehicle to the door panel 1.

According to the disclosure, since it is possible to set the operating force to the operating member to be substantially equivalent from the start to the end of the operation, it is possible to make the operation feeling of the handle device for the vehicle be excellent.

In a handle device for a vehicle of the disclosure which is fixed to a door 101 of a vehicle, and remotely operates a door latch device 103 that can perform a latch releasing operation by an electric actuator and a latch releasing operation by an operating force transmission member 102, the handle device includes an operating member 104 which is rotatably operable in a direction that matches an opening operation direction of the door 101 until reaching an emergency corresponding position via an operation position from an initial position, and which becomes a handle when performing the opening operation with respect to the door 101, a switch member 106 which transitions an operation circuit to be in a contact state with respect to the electric actuator as an actuator portion 105 is pushed in accordance with a rotation operation to the operation position of the operating member 104, a linking portion 107 which moves the operating force transmission member 102 to the operation position in accordance with the movement to the emergency corresponding position of the operating member 104, and a resistance applying portion 108 which holds the operating member 104 at the operation position by a predetermined holding force.

According to the disclosure, the handle device for the vehicle includes an operating member 104 in which a latch releasing operation of the door latch device 103 fixed to the door 101 using the displacement of the operating force transmission member 102, such as a cable device or a rod, or by operating the electric actuator, is remotely operated.

The operating member 104 can transition the switch member 106 to be in an ON state by performing the rotation operation from the initial position to the operation position, the electric actuator, such as a motor, is driven by the transition of the switch member 106 to the ON state, and the latch of the door latch device 103 is released.

In addition, the operating member 104 can perform the rotation operation to the emergency corresponding position exceeding the operation position, and when being rotated to the emergency corresponding position, by displacing the operating force transmission member 102, it is possible to perform the releasing operation of the door latch device 103.

Furthermore, the handle device for the vehicle of the disclosure includes the resistance applying portion 108 for holding the operating member 104 by a predetermined holding force at an operation position. When performing the rotation operation to the emergency corresponding position exceeding the operation position, the operating member 104 requires an operating force that exceeds the resistance force applied by the resistance applying portion 108. Therefore, in a general operation, only a disconnecting operation of the switch member 106 is performed by the rotation operation between the initial position and the operation position.

According to the disclosure, mechanical latch releasing means that uses the operating force transmission member 102 can be used as an emergency taking and releasing means in a case where the latch releasing operation with respect to the electric actuator is not excellently performed. By performing the rotation operation with respect to the operating member 104 to the emergency corresponding position, the latch releasing operation is performed by the mechanical latch releasing means.

In addition, according to the disclosure, the rotation operation direction from the initial position to the emergency corresponding position of the operating member 104 is set to be an opening direction of the door 101, that is, a direction of pushing out the door 101 in the handle device for the vehicle disposed on the interior side, and a direction of pushing out the door 101 in the handle device for the vehicle disposed on the exterior side. In a case where the electric actuator is not excellently operated, only by continuing the opening operation of the door 101 as it is, it is possible to rotate the operating member 104 to the emergency corresponding position.

When performing the opening operation with respect to the door 101, in a case where the door 101 is not excellently operated in the opening direction without releasing the latch, since the opening operating force to the door 101 is applied to the operating member 104 as it is, the operating force applied to the operating member 104 increases, and after this, it is possible to easily perform an operation during the emergency only by continuing the opening operation of the door 101 against the resistance feeling by the resistance applying portion 108.

As a result, even when the operation during the emergency is not stored in advance, it is possible to perform the rotation operation with respect to the operating member 104 to the emergency corresponding position only by continuing the natural opening operation of the door 101, and thus, it is possible to improve operability.

In addition, since the operating member 104 also functions as a handle portion when performing the opening operation with respect to the door 101, it is possible to achieve a psychological effect for naturally performing the transition to the operation during the emergency as continuation of the opening operation of the door 101, and to easily apply the operating force against the resistance in the resistance applying portion 108 compared to a case of pushing down the push button against a large resistance force as described in the above-described related art.

In addition, in the handle device for the vehicle of the disclosure, the operating member 104 is not limited to the shape of a lever linked to the fixed handle, and may be a movable handle itself which is operated to rotate when performing the opening and closing operation of the door 101.

In addition, in the handle device for the vehicle of the disclosure, a pushing portion 109 with respect to the actuator portion 105 of the switch member 106 may include a cam surface in which a pushing-in dimension is invariable after finishing pushing of the actuator portion 105 of a switch member 106 by the rotation to the operation position of the operating member 104 until reaching the emergency corresponding position.

According to the disclosure, by forming the pushing portion 109 with respect to the actuator portion 105 of the switch member 106 by the cam surface, it is possible to adjust a pushing-down speed with respect to the actuator portion 105 of the switch member 106 even in a case where the operating member 104 is suddenly operated, or the like, and further, the pushing-down operation by the cam surface of which the pushing-in dimension is invariable is not performed in a case of exceeding the operation position. Therefore, it is possible to reduce damage to the switch member 106.

In addition, in the handle device for the vehicle of the disclosure, the linking portion 107 may include a displacement suppression portion which suppresses displacement which occurs in accordance with the rotation operation to the operation position from the initial position of the operating member 104, and regulates transmission of an operating force to the operating force transmission member 102.

According to the disclosure, in a case where the operating member 104 is operated to rotate from the initial position to the operation position, that is, in a case of the latch releasing mode by a general electric actuator, the displacement by the rotation operation of the operating member 104 is suppressed by the displacement suppression portion, and the operating force transmission member 102 is not operated. Therefore, even when the operating force transmission member 102 is linked to the door latch device 103 without considering intrinsic characteristics of the door latch device 103, such as a play with respect to an operation in which the operating force transmission member 102 of the door latch device 103 is used, it is possible to reliably prevent access to the door latch device 103 by the operating force transmission member 102 under the general mode.

In addition, in the handle device for the vehicle of the disclosure, the linking portion 107 may include a rotating body 111 which is driven to rotate by the operating member 104, a follower body 113 which is driven by the cam portion 112 formed in the rotating body 111, and in which one end thereof is linked to the operating force transmission member 102, and a guide portion 114 which regulates a moving direction of the follower body 113.

According to the disclosure, in the disclosure in which the operating force of the operating member 104 is transmitted to the operating force transmission member 102 via the cam portion 112, by appropriately changing the cam curve of the cam portion 112, for example, it is possible to change the operation feeling with respect to the operating member 104, for example, by increasing or decreasing the operating force at an initial state of the operation.

In addition, in the handle device for the vehicle of the disclosure, the pushing portion 109 with respect to the actuator portion 105 of the switch member 106 may be formed at an outer circumference of the rotating body 111.

According to the disclosure, the pushing portion 109 with respect to the actuator portion 105 of the switch member 106 can make the structure of the handle device for the vehicle simple by using the outer circumference of the rotating body 111.

In the case, it is possible to prevent damage to the switch member 106 as the outer circumference of the rotating body 111 is formed by the cam surface of which the pushing-in dimension is invariable to reaching the emergency corresponding position after finishing the pressing of the actuator portion 105 of the switch member 106.

In addition, in the handle device for the vehicle of the disclosure, the resistance applying portion 108 may be formed by a cam portion which corresponds to a steep cam curve in a rotation angle in which an increment of a movement amount of the follower body 113 per unit operation angle of the operating member 104 exceeds the operation position.

According to the disclosure, by adjusting the cam curve by the cam portion 112 formed in the rotating body 111, it is possible to practically achieve a function as the resistance applying portion 108.

In other words, since the increment of the movement amount of a linking slider 126 is formed by the steep cam curve in an operation region, a large operating force becomes necessary for exceeding the region, and the cam portion 112 functions as the resistance applying portion 108.

Therefore, in the disclosure, it is possible to configure the resistance applying portion 108 of which an operation is reliable by a simple configuration.

In addition, the handle device for the vehicle of the disclosure, may further include a handle unit 116 in which the operating member 104 is linked to a base 115 fixed to a surface of a door panel 119, and a linking unit 118 in which the linking portion 107 and the switch member 106 are linked to a unit base 117 fixed to a front surface of the door panel 119.

According to the disclosure, by making the handle device as a unit including the handle unit 116 and the linking unit 118, and by fixing each of the units to the rear surface of the door panel 119, after fixing the handle unit 116 to the door 101, the fixing work to the door 101 is finished only by fixing the linking unit 118, and thus, it is possible to improve the fixing workability to the door 101.

In addition, in a case of incorporating the handle unit 116 and the linking unit 118 which are fixed to the front surface of the panel, as the door panel 119 separates the linking unit 118 from the handle unit 116, it becomes possible to reduce the size of the mounting opening of the door panel 119, the linking unit 118 is made as a unit, and thus, the fixing work to the surface of the door panel 119 surface also becomes simple.

According to the disclosure, even when the operation during the emergency is not stored in advance, it is possible to perform the rotation operation with respect to the operating member to the emergency corresponding position only by continuing the natural opening operation of the door. Furthermore, since the operating member is formed to be a handle during the opening operation of the door, it is possible to efficiently transmit the operating force to the emergency corresponding position, and to improve usability.

BRIEF DESCRIPTION OF DRAWINGS

FIG. 27A is a view illustrating a state of being rotated to an operation rotation position. FIG. 27B is a view illustrating a state of being rotated from the operation rotation position to a rotation finishing end position. FIG. 27C is a view illustrating a state of being rotated to the rotation finishing end position.

FIG. 28A is a timing chart of the operation angle and a switch disconnection. FIG. 28B is a graph of the operation angle and a follower body displacement amount. FIG. 28C is a graph of the operation angle and an operating force.

DESCRIPTION OF EMBODIMENTS

Figure 1:
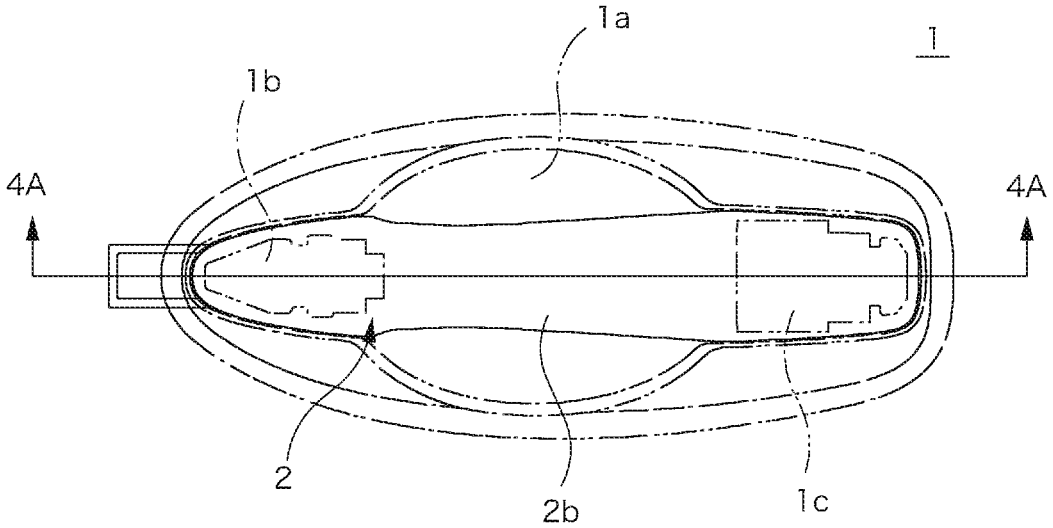
FIG. 1 is a front view illustrating a handle device illustrating a state of being attached to a door.

As illustrated in FIG. 1 and the following drawings, a door handle device is configured to include a handle unit 10 which links a movable handle that functions as an operating member 3 to a fixed handle that functions as a base 2, and an output portion unit 12 which holds an output portion 4 to a unit base 11.

Figure 4:
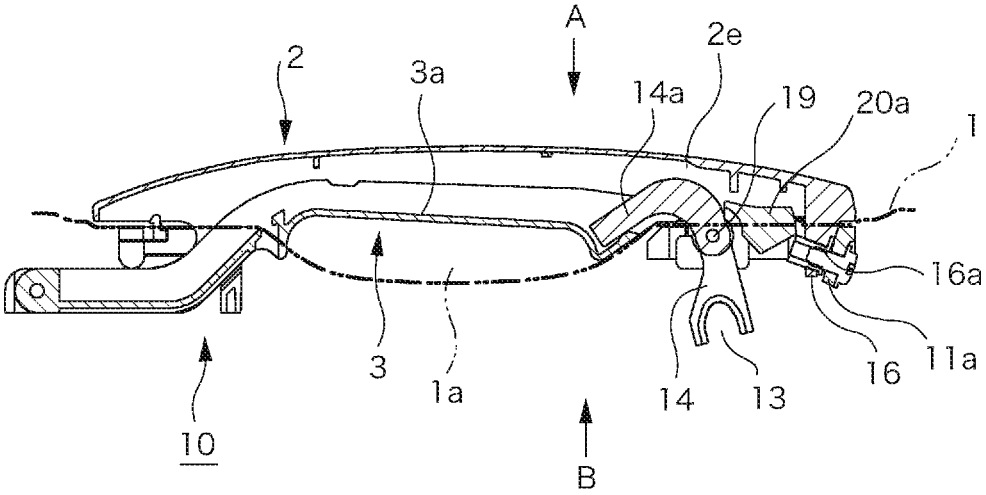
FIG. 4 is a sectional view taken along line 4A-4A of FIG. 1.

Fixing of the handle unit 10 to a door 1 is performed by fixing the fixed handle to a front surface of a door panel (door 1) in a posture in which a left side is oriented toward a front part of a vehicle in FIG. 1 (hereinafter, in the specification, "upward-and-downward" and "forward-and-rearward" directions are defined considering a posture of being attached to a vehicle as a standard, the upward direction in FIG. 4 is a "front surface side", and a side opposite thereto is "rear surface side").

In addition, as illustrated in FIGS. 1 and 4, in the door panel 1, a recess portion 1*a* for ensuring an insertion space of a hand is formed between the front surfaces of the door panel 1 when performing an opening operation of the door 1, and further, front and rear portion mounting openings 1*b* and 1*c* for fixing the fixed handle 2, are installed to be open.

Figure 5:
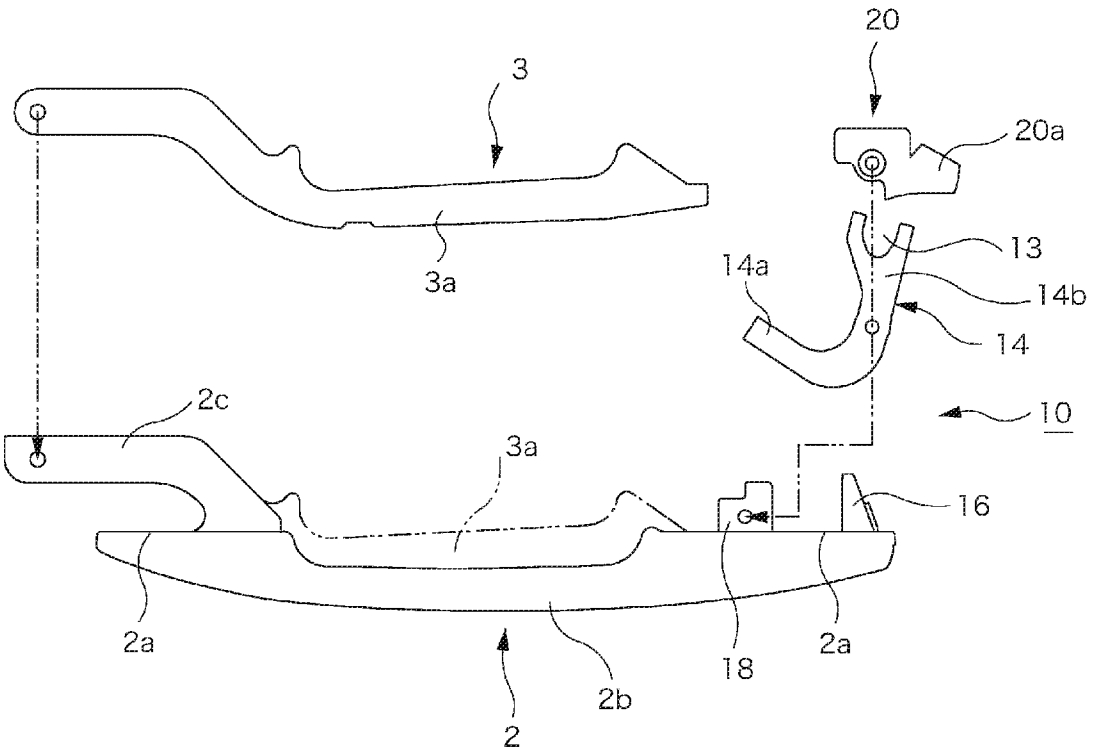
FIG. 5 is an exploded view of the handle unit.

As illustrated in FIG. 5, the fixed handle 2 includes door attaching surfaces 2*a* in a front and rear end portions, and at the center portion thereof, a handle corresponding portion 2*b* which corresponds to the recess portion 1*a* of the door panel 1 and floats up from the front surface of the door panel 1, is provided.

Fixing of the fixed handle 2 to the door 1 is performed by screwing a fixing block 16 formed at the rear end portion to the door panel 1 after inserting the fixing block 16 into the door 1 from the rear portion mounting opening 1*c*, and by mounting an appropriate clip member which is inserted into the door 1 from the front portion opening 1*b* on the front end portion. In the fixing block 16, a screw insertion through-hole 16*a* which is used in screwing to the door panel 1 is provided (refer to FIGS. 3 and 4).

In the movable handle 3, one end is pivotally supported to be freely rotatable by a hinge protruding piece 2*c* that enters the door 1 in a state of protruding from the front end of the fixed handle 2 and being fixed to the door 1, and is held at an initial rotation position illustrated in FIG. 4.

In addition, in the fixed handle 2, a fitting groove 2*d* for accommodating the movable handle 3 is formed to longitudinally pass (refer to FIG. 2), and further, in the movable handle 3 and the fixed handle 2, the movable handles 3 respectively exceed the initial rotation position, and a stopper (not illustrated) for regulating the clockwise rotation in FIG. 4 is provided.

The movable handle 3 has a length that exceeds the handle corresponding portion 2*b* from a linking end linked to the fixed handle 2 and reaches the rear end portion of the fixed handle 2, and in an intermediate portion, a handle portion 3*a* which corresponds to the handle corresponding portion 2*b* of the fixed handle 2 is formed. As illustrated by a chain line in FIG. 5, when the movable handle 3 is at the initial rotation position, the handle portion 3*a* overhangs toward the rear surface side from the handle corresponding portion 2*b* of the fixed handle 2, and an operation with respect to the front surface side is ensured.

Figure 3:
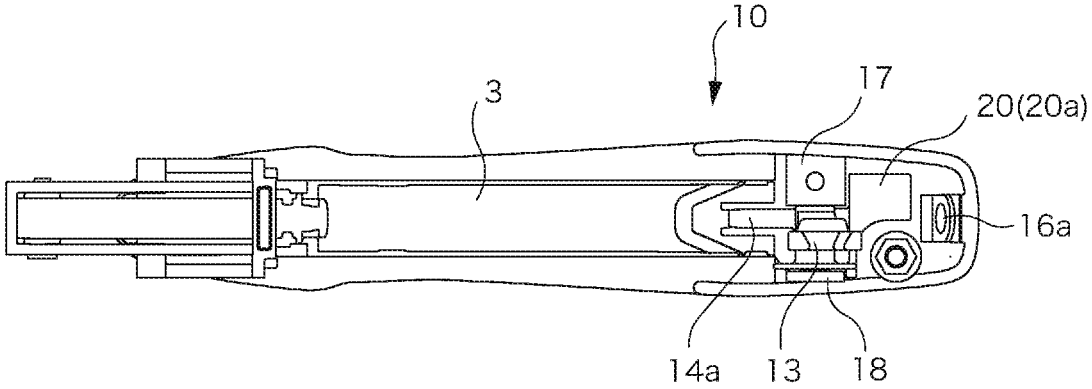
FIG. 3 is a rear view of a handle unit.

In addition, as illustrated in FIGS. 3 and 5, in the rear end portion of the fixed handle 2, a pin receiving block 17 and a pin receiving piece 18 are installed to protrude toward the rear surface, and a lever 14 and a counter weight 20 are coaxially linked to each other around a rotation shaft 19 which is built between the pin receiving block 17 and the pin receiving piece 18 and is disposed in the upward-and-downward direction.

The lever 14 includes a moved piece 14*a* which overhangs toward the front part in one end portion, and an operating piece 14*b* which is provided with a fork-shaped linked portion 13 at a tip end and overhangs toward the rear surface side, is formed in a substantially L shape, and is pivotally supported in the vicinity of a curved portion.

Figure 6:
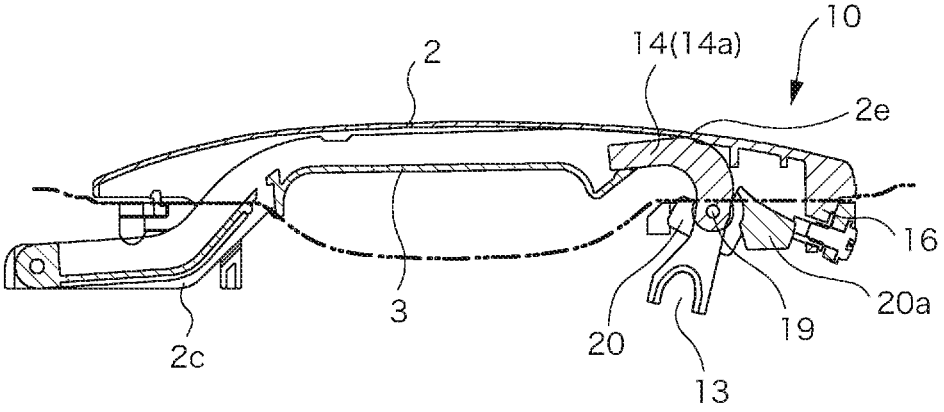
FIG. 6 is a sectional view taken along line 4A-4A of FIG. 1 illustrating an operation state of the handle unit.

As illustrated in FIG. 4, in a state where the output lever 14 is mounted, the tip end of the moved piece 14*a* corresponds to the rear end portion of the movable handle 3, and the lever 14 rotates between an initial rotation position determined by the initial rotation position of the movable handle 3 and an operation rotation position that abuts against a lever stopper portion 2*e* in which the moved piece 14*a* is formed in the fixed handle 2, as illustrated in FIG. 6.

The counter weight 20 is formed of a metal material, such as zinc die cast, such that a predetermined weight is generated, and moves the center of gravity to the rear part by disposing a weight portion 20*a* having a large capacity at the rear part with respect to the rotation shaft 19 (refer to FIGS. 3 and 4).

The counter weight 20 abuts against the lever 14 being biased in a counterclockwise direction in FIG. 4 by a torsion spring which is not illustrated, and rotates following the rotation of the lever 14 toward the operation rotation position (in a clockwise direction in FIG. 4).

In addition, the counter weight 20 freely revolves in the clockwise direction with respect to the lever 14, and when the lever 14 is at the initial rotation position, it is possible to rotate only the counter weight 20 in the clockwise direction.

Therefore, in the example, in a non-operating state (initial state) where the handle unit 10 is fixed to the door 1, as illustrated in FIG. 4, the lever 14 is held at the initial rotation position by a biasing force of the counter weight 20, and according to this, the movable handle 3 pushed to the moved piece 14*a* of the lever 14 is held at the initial position.

When hooking a fingertip to the handle portion 3*a* from the state and pulling the movable handle 3 to the front surface side, as illustrated in FIG. 6, the lever 14 and the counter weight 20 are pressed to the movable handle 3, rotates in the counterclockwise direction in FIG. 6, and moves to the operation rotation position.

In addition, in the initial state illustrated in FIG. 4, in a case where a side surface collision force is applied in an arrow A direction, an inertia in the operation rotating direction acts on the movable handle 3, and the lever 14 rotates in the operation rotating direction, a rotating force in the counterclockwise direction is generated by the inertia in the counter weight, an operation of the lever 14 is regulated, and releasing of a locked state of the door 1 is avoided.

Furthermore, in a case where a side surface collision force in an arrow B direction is applied in FIG. 4, since only the counter weight 20 rotates in the clockwise direction and the lever 14 does not rotate, the releasing of the locked state of the door 1 is avoided.

Figure 7:
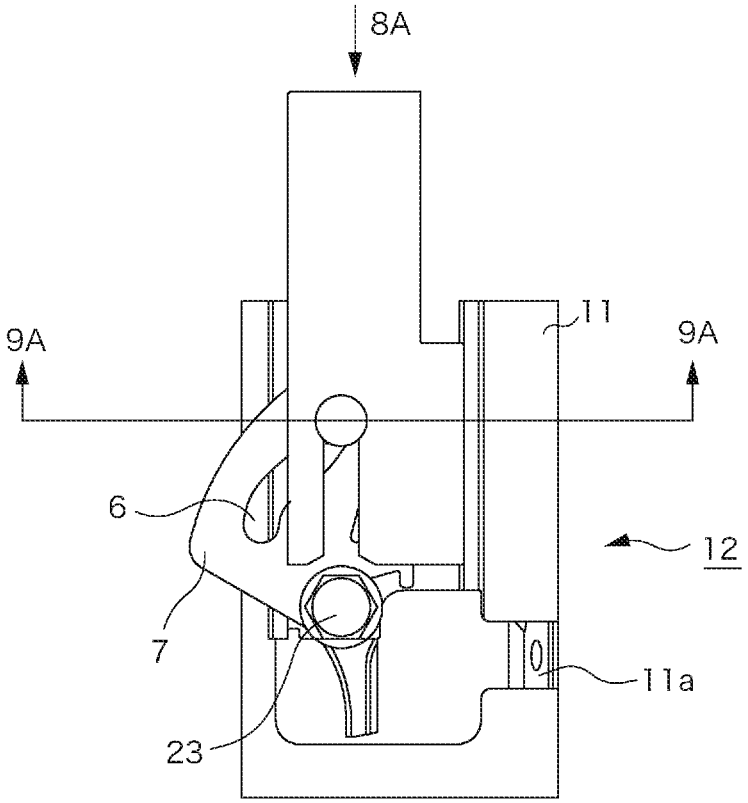
FIG. 7 is a view illustrating an output portion unit.
Figure 8:
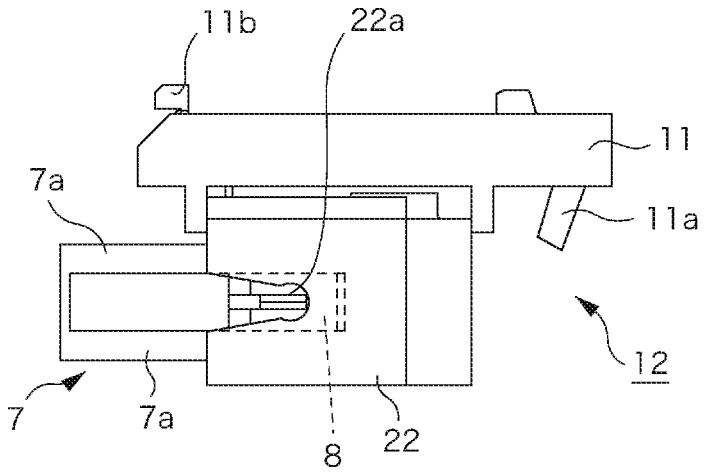
FIG. 8 is an arrow view in an 8A direction of FIG. 7.

Meanwhile, as illustrated in FIG. 7 and the following drawings, the output portion unit 12 is formed to mount a cam body 7 and the output portion 4 configured of a linking slider on the unit base 11, and is fixed to the door 1 from the rear surface of the door panel 1. As illustrated in FIGS. 7 and 8, in the unit base 11, an attaching piece 11*a* for being jointly fastened to the door panel 1 together with the fixing block 16 of the fixed handle 2, and a locking claw 11*b* for locking to a circumferential edge of the rear portion opening 1*c* of the door panel 1, are formed.

Figure 9:
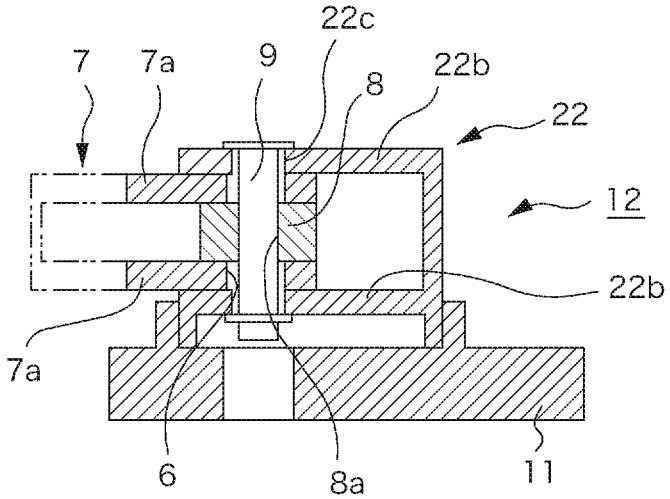
FIG. 9 is a sectional view taken along line 9A-9A of FIG. 7.
Figure 10:
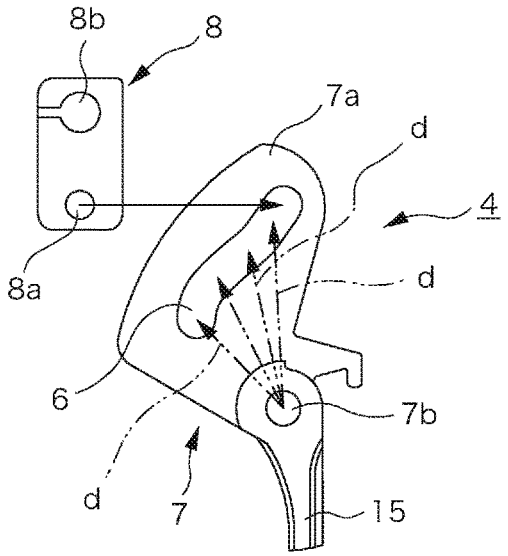
FIG. 10 is an exploded view of an output portion.

As illustrated in FIGS. 9 and 10, the cam body 7 includes a rod-like linking portion 15 at one end, includes two blade pieces 7*a* which oppose the other end, and includes a rotation shaft insertion through-hole 7*b* installed to be open in the intermediate portion. In each of the blade pieces 7*a*, a long hole-like cam portion 6 having a width dimension by which a follower pin 9 which will be described later can be inserted to be freely movable is formed.

A linking slider 8 includes a pin stator 8*a* at one end and a wire linking hole 8*b* for linking an inner wire of a cable device 21 at the other end, is formed in a rectangular shape, and after being fitted to be nipped between the blade pieces 7*a* of the cam body 7, the linking slider 8 is linked by the follower pin 9 which penetrates the cam portion 6 and the pin stator 8*a*.

Figure 11:
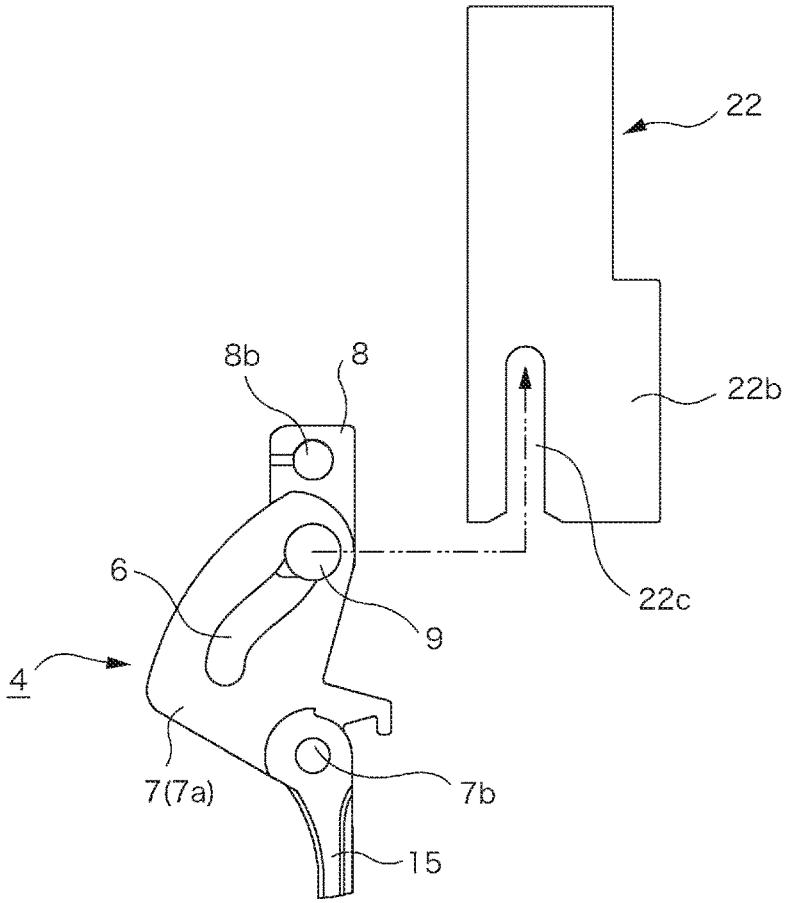
FIG. 11 is a view illustrating a state where the output portion is attached to the linking slider.
Figure 12:
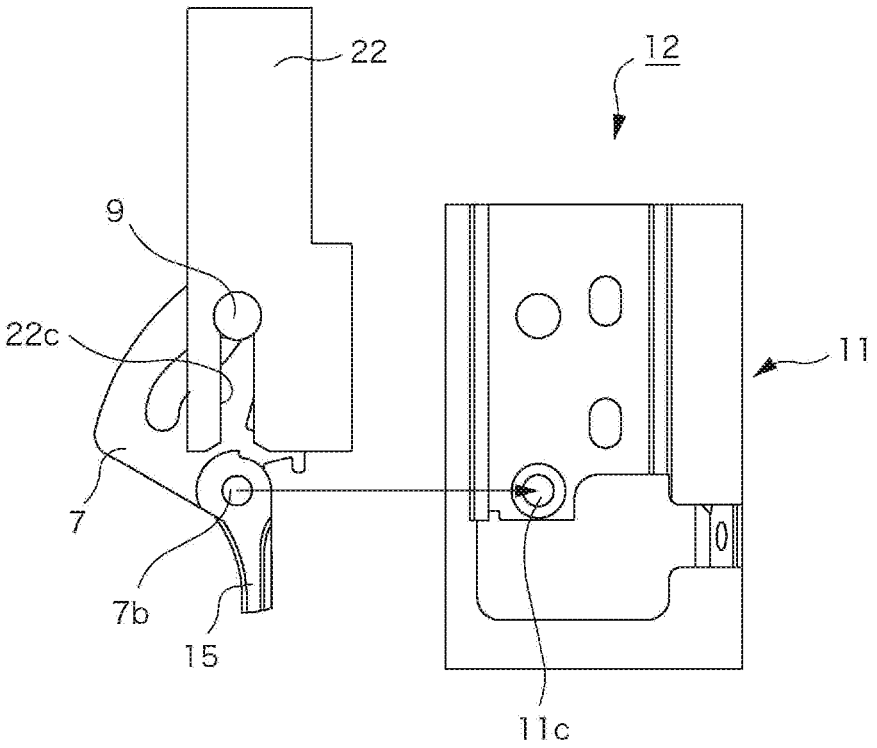
FIG. 12 is a view illustrating a state where the output portion is attached to a unit base.

As illustrated in FIGS. 9 and 11, after being mounted on a slide guide 22, the cam body 7 which links the linking slider 8 as described above is linked to the unit base 11 by a linking pin 23 which penetrates the rotation shaft insertion through-hole 7*b* and a cam attaching hole 11*c* formed in the unit base 11 (refer to FIGS. 7 and 12). As illustrated in FIG. 8, in the slide guide 22, a cable linking recess portion 22*a* for linking an outer cable of the cable device 21 linked to the linking slider 8, is formed.

The slide guide 22 is formed to open a guide long hole 22*c* into which the above-described follower pin 9 can be inserted, in one pair of blade pieces 22*b* that nip the cam body 7 therebetween, and the cam body 7 is incorporated by allowing the follower pin 9 to pass through from an opening end of the guide long hole 22*c*.

Figure 2:
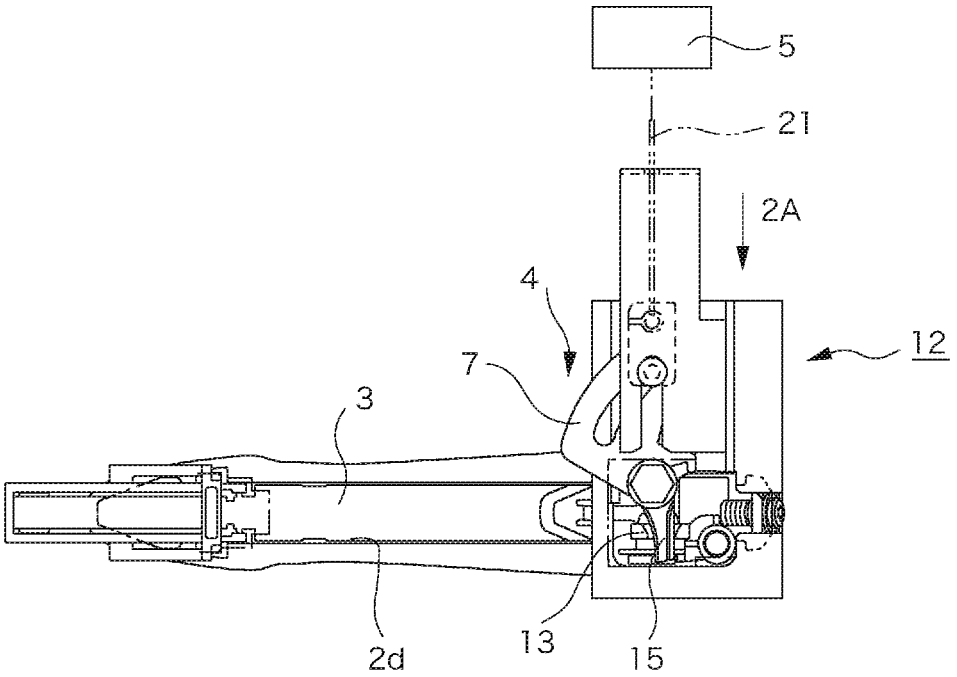
FIG. 2 is a rear view illustrating the handle device.

In the above-described output portion unit 12, the cam body 7 is held at the initial rotation position illustrated in FIG. 7 by a spring which is not illustrated, the linked portion 13 of the lever 14 is fitted to the linking portion 15 of the cam body 7 in accordance with the linking operation of the handle unit 10 and the unit base 11, and then, the linking slider 8 slides in accordance with the operation of the movable handle 3 of the handle unit 10, and a door lock device 5 is operated via the cable device (refer to FIG. 2).

Next, the action of the cam body 7 will be described in detail. As described above, when performing the rotation operation with respect to the movable handle 3 from the initial rotation position to the operation rotation position in a state where the handle device is attached to the door 1, since a lever ratio between a transmission side and a transmitted side between the movable handle 3 and the lever 14 and between the lever 14 and the cam body 7 is substantially constant in the entire operation process of the movable handle 3, ratios between an operation angle with respect to the movable handle 3 and an operation angle of the cam body 7 substantially match each other in the entire operation process.

Meanwhile, as illustrated in FIG. 10, the cam portion 6 which configures a transmission portion of the cam body 7 and the linking slider 8 is formed such that a distance (d) from the rotation center of the cam body 7 gradually decreases as moving from the initial rotation position toward the operation rotation position. As a result, when the cam body 7 rotates from the initial rotation position, the linking slider 8 linked to the cam portion 6 is pulled in the rotation center direction of the cam body 7, that is, the 2A direction of FIG. 2, and operates the door lock device 5.

Furthermore, the cam portion 6 is set such that an increment (Δd) of the distance (d) from the rotation center with respect to the same increment (Δθ) of the rotation angle of the cam body 7 increases at an initial state of the rotation, and decreases at a later stage of the rotation.

Figure 14:
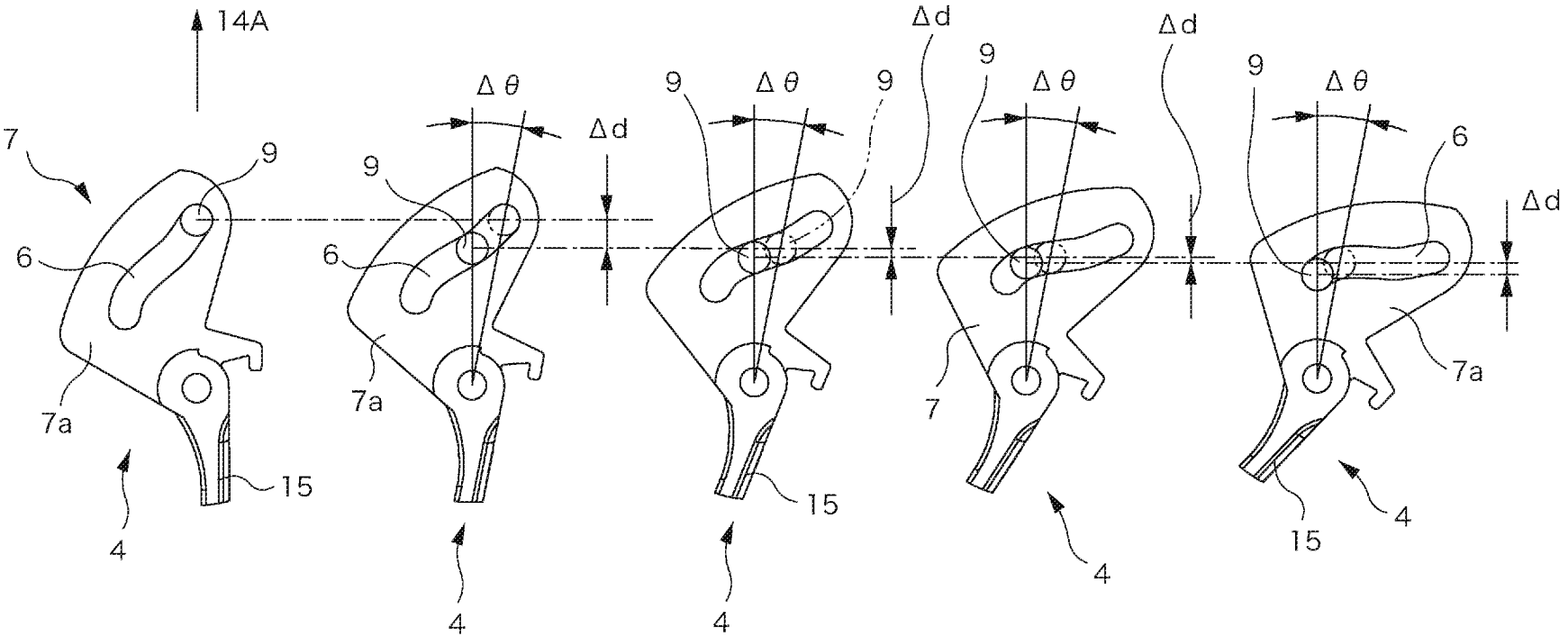
FIG. 14 is an explanation view illustrating an operation of the output portion.

FIG. 14 illustrates the increment (Δd) of the distance from the rotation center in an arrow 14A direction when the left side consecutively rotates by an increment (Δθ) from the initial rotation position and moves to the operation rotation position on the right side, that is, the sliding direction of the linking slider 8.

As illustrated in FIG. 14, the increment (Δd) at the initial state of the rotation of the cam body 7 is larger compared to that at the later stage of the rotation, and the vicinity of the minimum angle (fourth from the left in FIG. 14) substantially matches the position at which the resistance from the door lock device 5 becomes the maximum, that is, the position at which the releasing of the locked state is performed by locking the door 1.

Since the operating force generated in the cam body 7, that is, the linking slider 8 by the operation of the movable handle 3, is proportional to the moving distance of the linking slider 8 with respect to a unit rotation angle of the movable handle 3, the operating force of the linking slider 8 becomes small at the initial state of the operation of the movable handle 3 and becomes large at the later stage.

Figure 13A:
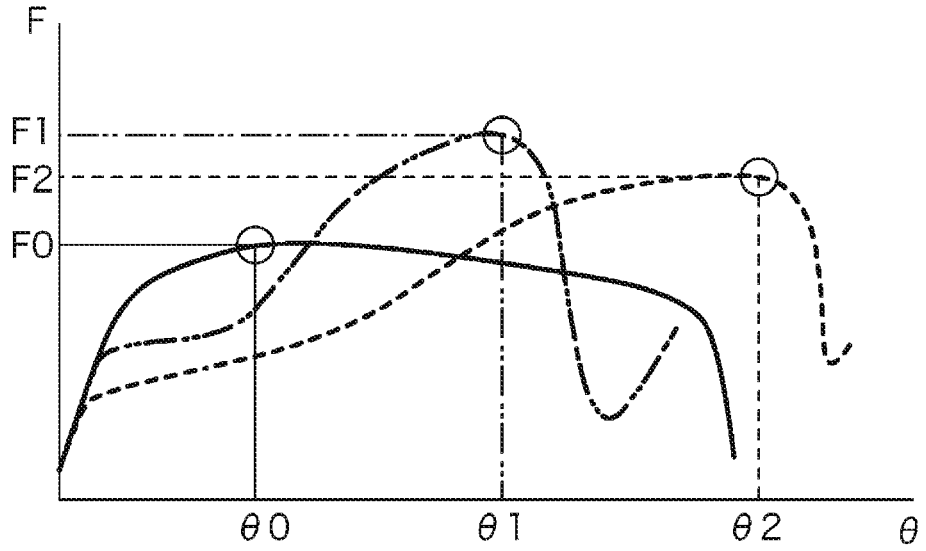
FIGS. 13A and 13B are graphs of an operation angle and an operating force of an operating member.

When considering a change in resistance from the door lock device 5, a relationship of the operating force (operation resistance) and an operation angle with respect to the movable handle 3 is achieved as illustrated in FIG. 13A in which a horizontal axis is the rotation angle (θ) of the movable handle 3 and a longitudinal axis is the operating force (operation resistance) (F) of the movable handle 3.

In FIG. 13A, a chain line indicates that the operation resistance becomes a peak (peak value F1) at the operation angle (θ1) that corresponds to the door lock releasing, in a graph illustrating a line that corresponds to an example of the related art in which the increment of the movement distance of the linking slider 8 with respect to the operation angle of the movable handle 3 does not change.

Meanwhile, in the embodiment in which there is a change in increment of the movement distance of the linking slider 8 with respect to the operation angle of the movable handle 3, as illustrated by a solid line in FIG. 13A, the operating force of the linking slider 8 also increases at a time (θ0) at which the resistance from the door lock device 5 becomes the maximum, and further, the operating force of the linking slider 8 also decreases at a stroke initial stage at which the resistance from the door lock device 5 is small, and thus, the peak value (F0) of the operation resistance of the handle moves forward, and the peak value also becomes small.

Therefore, in the embodiment, while it is possible to reduce the maximum operating force of the movable handle 3, the change in operating force that reaches the peak value is smooth, there is not a case where the movable handle 3 suddenly becomes heavy, and thus, operability becomes excellent.

Figure 13B:
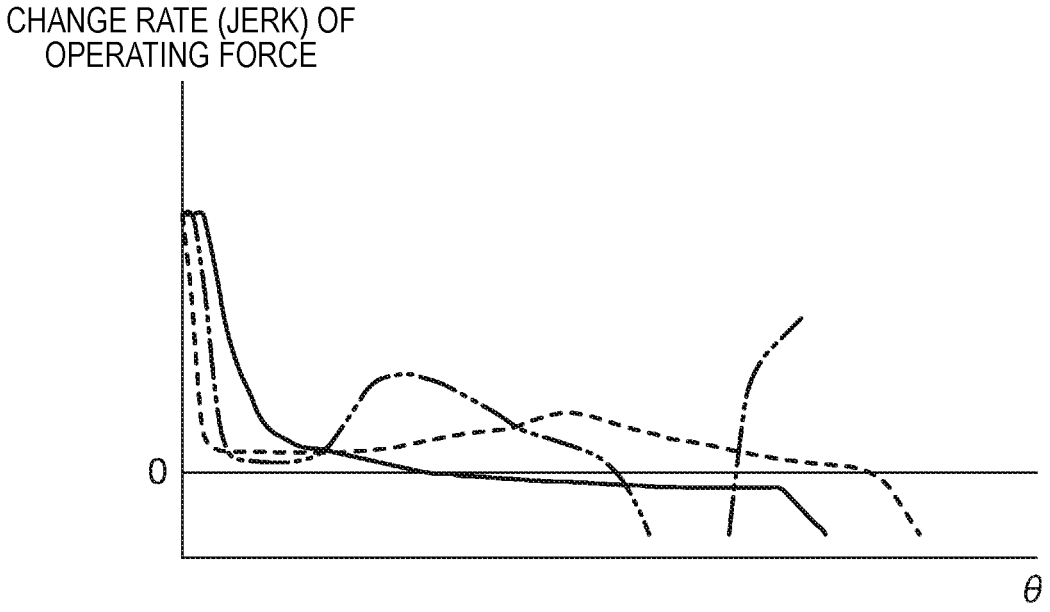

In addition, the peak value, the timing at which the peak value is achieved, and the change to reach the peak value can be appropriately changed according to the design of the cam portion 6, and for example, as illustrated by a broken lines in FIGS. 13A and 13B, it is also possible to shift an operation angle (θ2) to the rear part during the peak, and to reduce a peak value (F2).

In addition, it is also possible to improve the operation feeling by designing a cam portion 106 such that a change rate that reaches the peak value becomes smoother.

A relationship of the operation feeling and the change that reaches the peak value is illustrated in FIG. 13B in which a horizontal axis is a rotation angle (θ) of a movable handle 103 and a longitudinal axis is a ratio of a change in operating force of the movable handle 103.

In FIG. 13A, as illustrated by a solid line, by decreasing the maximum operating force of the movable handle 103 and by making the change in operating force that reaches the peak value smooth, as illustrated by a solid line of FIG. 13B, a change rate (jerk) of the operating force per operation angle decreases without a limit in a section immediately after starting the operation and immediately before finishing the operation.

Therefore, in the embodiment, since it is possible to reduce the change rate of the operating force per operation angle of the movable handle 103, it is possible to reduce unpleasant rattling which occurs in accordance with the operation of the movable handle 103, and the operation feeling is improved.

In addition, above, a handle device in which the movable handle 3 is linked to the fixed handle 2 in advance and which is fixed to the door 1, is described, but the invention can also be employed in a handle device in which the base 2 is fixed to the rear surface of the door panel 1 in advance and the movable handle 3 that provides a handle when performing the opening operation with respect to the door 1 is mounted on the base 2 from the front surface side of the door 1 as the operating member 3.

FIGS. 15 to 28C illustrate an embodiment configured as an outside handle device.

The outside handle device is configured to include a handle unit 116 which links an operating member 104 to a fixed handle that functions as a base 115 in advance, and a linking unit 118 in which a linking portion 107 is disposed in a unit base 117.

Figure 15:
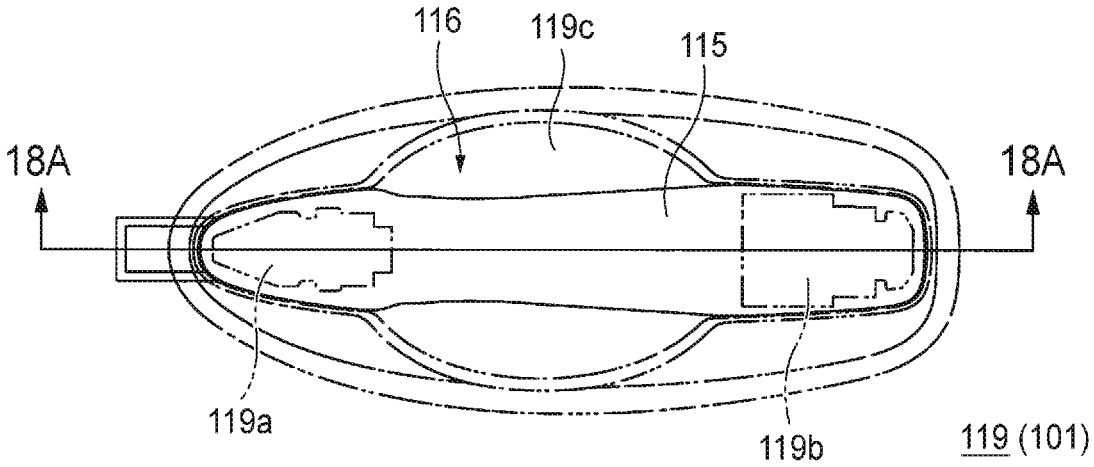
FIG. 15 is a front view illustrating the handle device illustrating a state of being attached to the door.
Figure 18:
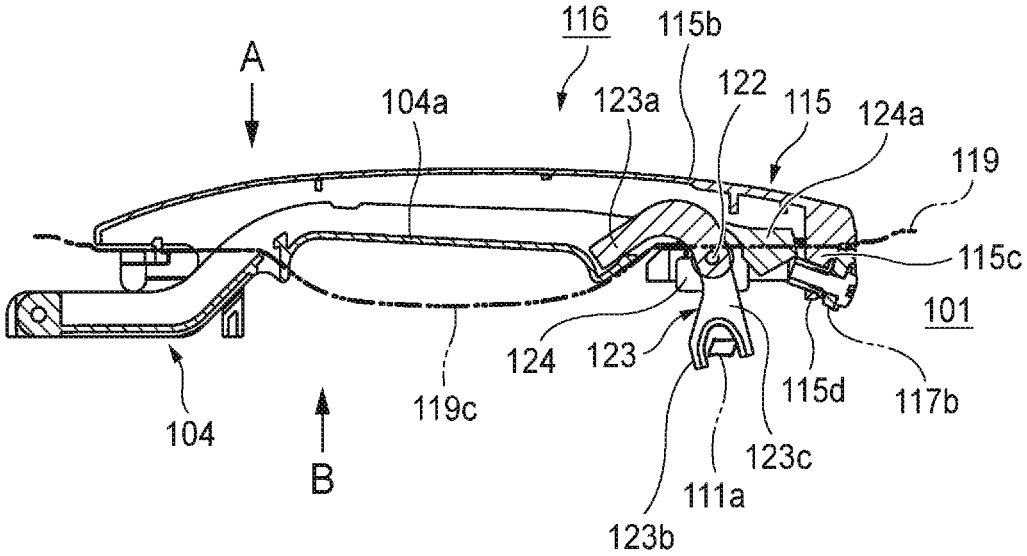
FIG. 18 is a sectional view taken along line 18A-18A of FIG. 15.

The handle unit 116 is attached to a door 101 in a posture in which a left side is oriented toward a front part of the vehicle in FIG. 15 (hereinafter, in the specification, "upward-and-downward" and "forward-and-rearward" directions are defined considering a posture of being attached to a vehicle as a standard, the upward direction in FIG. 18 is a "front surface side", and a side opposite thereto is "rear surface side").

In a door panel 119, front and rear portion mounting openings 119*a* and 119*b* (refer to FIG. 15) which are installed to be open for fixing the fixed handle 115, and a recess portion 119*c* (refer to FIG. 18) for ensuring an insertion space of a hand between the front surfaces of the door panel 119 when performing an opening operation of the door 101, are formed.

Figure 19:
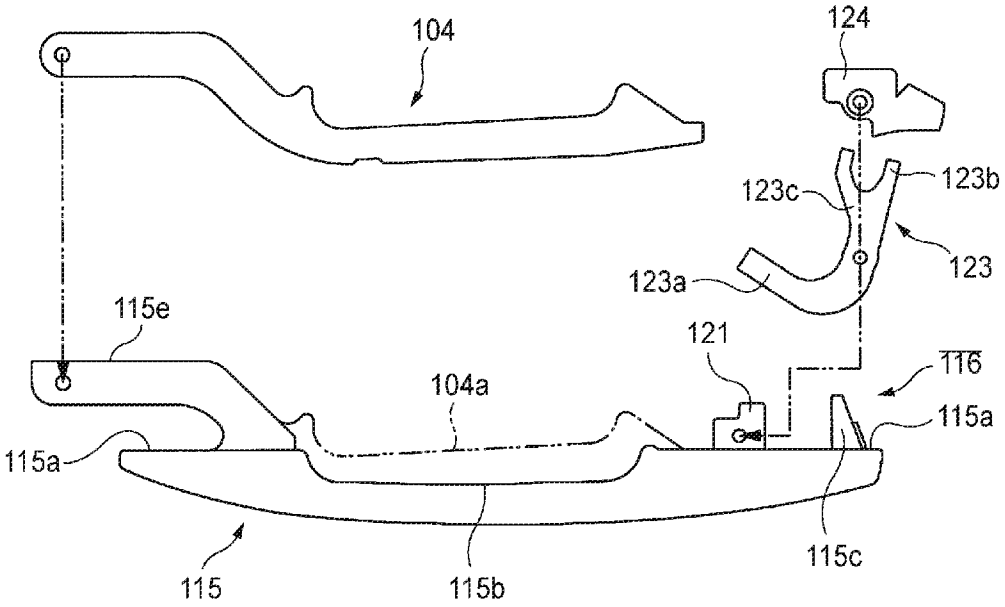
FIG. 19 is an explanation view of the handle unit.

As illustrated in FIG. 19, the fixed handle 115 includes a door attaching surface 115*a* in a front and rear end portions, and at the center portion thereof, a handle corresponding portion 115*b* which corresponds to the recess portion 119*c* of the door panel 119 and floats up from the front surface of the door panel 119, is provided.

Fixing of the fixed handle 115 to the door 101 is performed by screwing a fixing block 115*c* formed at the rear end portion to the door panel 119 after inserting the fixing block 115*c* into the door 101 from the rear portion mounting opening 119*b*, and by mounting an appropriate clip member which is inserted into the door 101 from the front portion opening 119*a* on the front end portion. In the fixing block 115*c*, a screw insertion through-hole 115*d* which is used in screwing to the door panel 119 is provided (refer to FIGS. 17 and 18).

Figure 20:
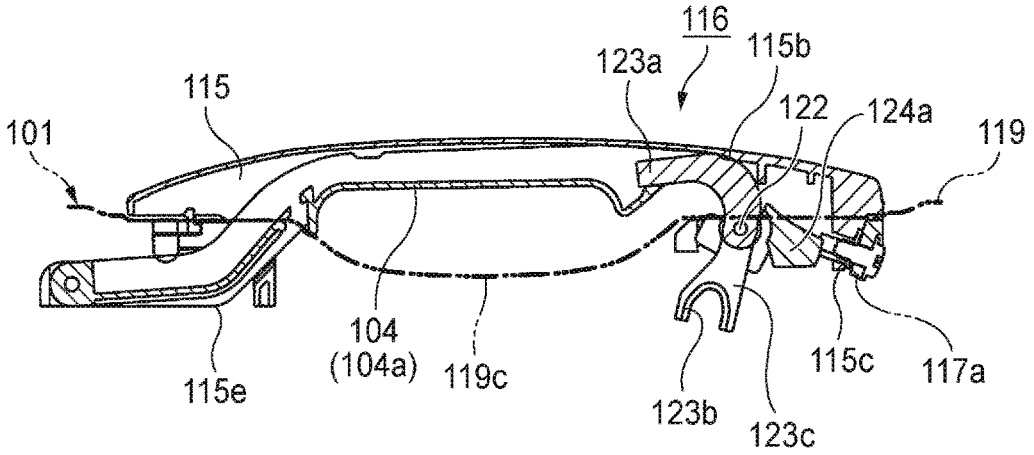
FIG. 20 is a sectional view taken along line 4A-4A of FIG. 1 illustrating an operation state of the handle unit.

Meanwhile, in the operating member 104, one end is pivotally supported by a hinge protruding piece 115*e* that enters the door 101 in a state of protruding from the front end of the fixed handle 115 and being fixed to the door 101, and the operating member 104 rotates between the initial position illustrated in FIG. 18 and the emergency corresponding position illustrated in FIG. 20. The rotating direction of the operating member 104 is set to match a direction in which a free end is pulled to the outside of the door 101 when moving to the emergency corresponding position, that is, the rotating direction of the door 101.

Figure 17:
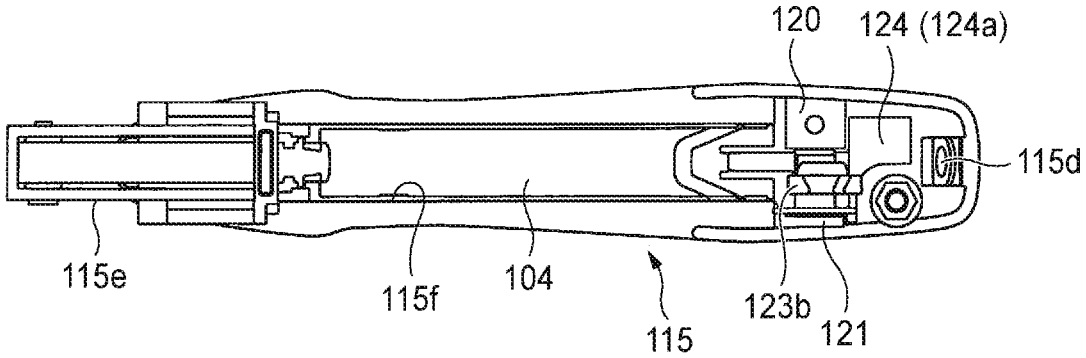
FIG. 17 is a rear view of the handle unit.

As illustrated in FIG. 17, the operating member 104 is accommodated in a fitting groove 115*f* formed to longitudinally pass the fixed handle 115, and in the operating member 104 and the fixed handle 115, the operating member 104 exceeds the initial position, and a stopper (not illustrated) for regulating the clockwise rotation in FIG. 18 is provided.

The operating member 104 has a length that exceeds the handle corresponding portion 115*b* from a linking end linked to the fixed handle 115 and reaches the rear end portion of the fixed handle 115, and in an intermediate portion, a handle portion 104*a* which corresponds to the handle corresponding portion 115*b* of the fixed handle 115 is formed. As illustrated by a chain line in FIG. 19, when the operating member 104 is at the initial position, the handle portion 104*a* overhangs toward the rear surface side from the handle corresponding portion 115*b* of the fixed handle 115, and an operation with respect to the front surface side is ensured. Furthermore, when hooking a fingertip to the fixed handle 115 and opening the door 101, an opening operating force of the door 101 is also loaded on the operating member 104.

In addition, as illustrated in FIGS. 17 and 19, in the rear end portion of the fixed handle 115, a pin receiving block 120 and a pin receiving piece 121 are installed to protrude toward the rear surface, and a lever 123 and a counter weight 124 are coaxially linked to each other around a rotation shaft 122 which is built between the pin receiving block 120 and the pin receiving piece 121 and is disposed in the upward-and-downward direction.

The lever 123 includes a moved piece 123*a* which overhangs toward the front part in one end portion, and an operating piece 123*c* which is provided with a fork-shaped output portion 123*b* at a tip end and overhangs toward the rear surface side, is formed in a substantially L shape, and is pivotally supported in the vicinity of a curved portion.

As illustrated in FIG. 18, in a state where the lever 123 is mounted on the fixed handle 115, the tip end of the moved piece 123*a* corresponds to the rear end portion of the operating member 104, and the lever 123 rotates between an initial rotation position determined by the initial position of the operating member 104 and a rotation finishing end position that abuts against a lever stopper portion 115*g* in which the moved piece 123*a* is formed in the fixed handle 115, as illustrated in FIG. 20.

The counter weight 124 is formed of a metal material, such as zinc die cast, such that a predetermined weight is generated, and moves the center of gravity to the rear part by disposing a weight portion 124*a* having a large capacity at the rear part with respect to the rotation shaft 122 (refer to FIGS. 17 and 18).

The counter weight 124 abuts against the lever 123 being biased in a counterclockwise direction in FIG. 18 by a torsion spring which is not illustrated, and rotates following the rotation (in a clockwise direction in FIG. 18) of the lever 123 toward the rotation finishing end position.

In addition, the counter weight 124 freely revolves in the clockwise direction with respect to the lever 123, and when the lever 123 is at the initial rotation position, it is possible to rotate only the counter weight 124 in the clockwise direction.

Therefore, in the example, in a non-operating state (initial state) where the handle unit 116 is fixed to the door 101, as illustrated in FIG. 18, the lever 123 is held at the initial rotation position by a biasing force of the counter weight 124, and according to this, the operating member 104 pushed to the moved piece 123*a* of the lever 123 is held at the initial position.

When hooking a fingertip to the handle portion 104*a* and pulling the operating member 104 to the front surface side, as illustrated in FIG. 20, the lever 123 and the counter weight 124 are pressed to the operating member 104, and moves to the rotation finishing end position.

In addition, in the initial state illustrated in FIG. 18, in a case where a side surface collision force is applied in an arrow A direction, an inertia in the operation rotating direction acts on the operating member 104, and the lever 123 rotates in the operation rotating direction, a rotating force in the counterclockwise direction is generated by the inertia in the counter weight 124, a rotation operation of the operating member 104 toward the emergency corresponding position is avoided.

Furthermore, in a case where a side surface collision force in an arrow B direction is applied in FIG. 18, only the counter weight 124 rotates in the clockwise direction and the lever 123 does not rotate.

Figure 21:
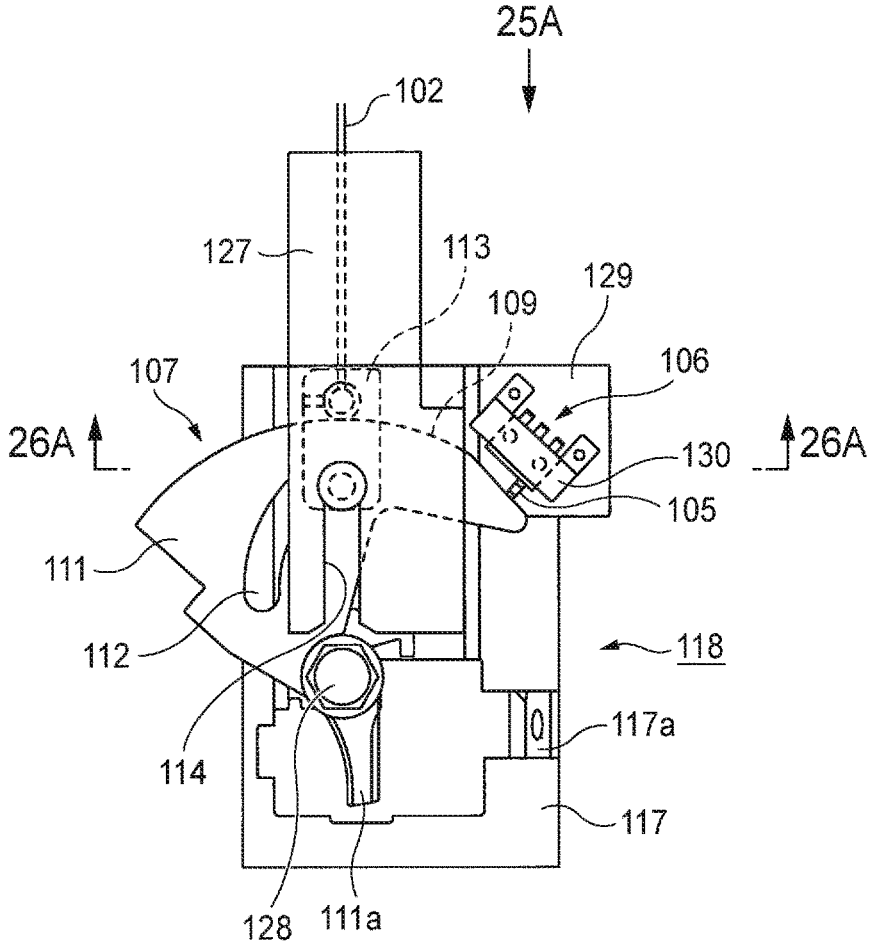
FIG. 21 is a view illustrating a linking unit.

Meanwhile, as illustrated in FIG. 21 and the following drawings, the linking unit 118 is formed to mount a linking portion 107 including a rotating body 111, a follower body 113, and a guide portion 114, and the switch member 106 configured of a micro switch, on the unit base 117, and is fixed to the door 101 from the rear surface of the door panel 119.

Figure 24:
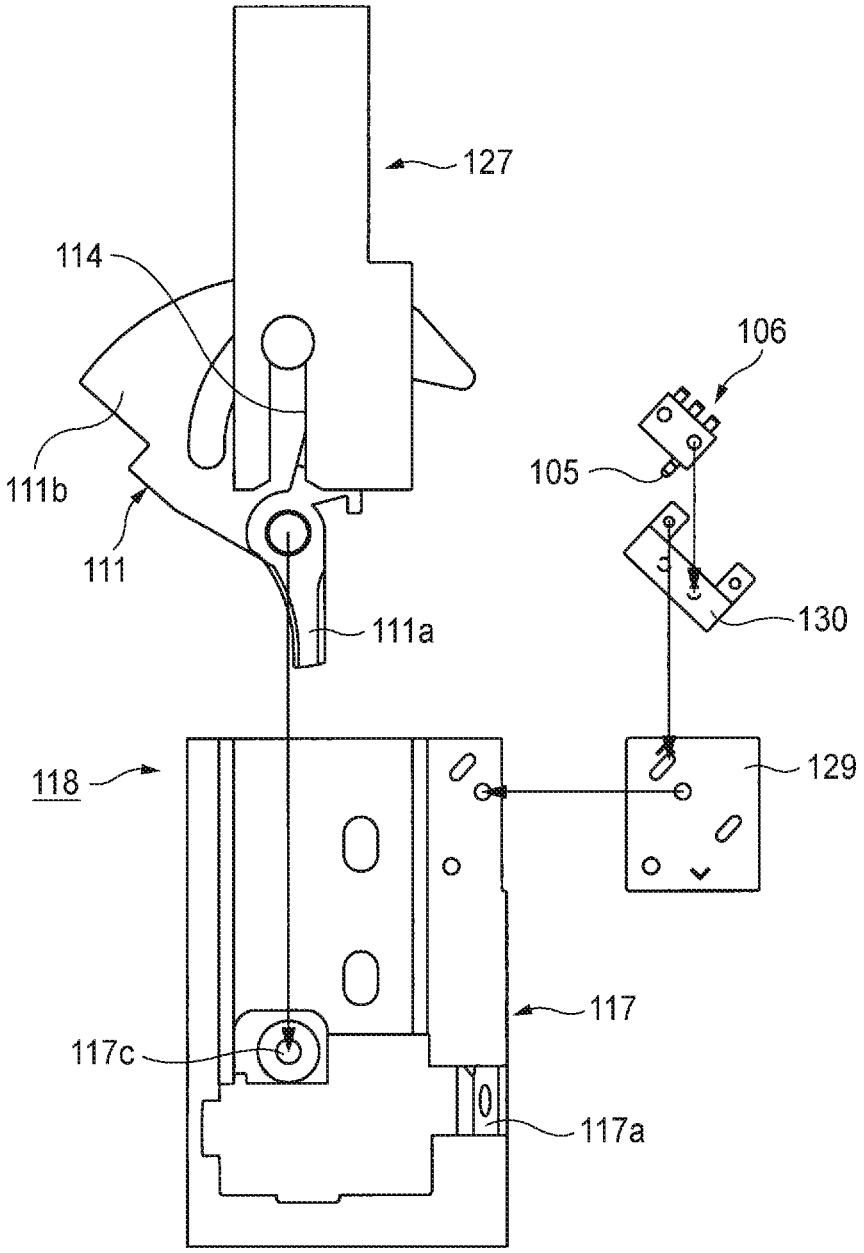
FIG. 24 is a view illustrating an assembly process of the linking unit.
Figure 25:
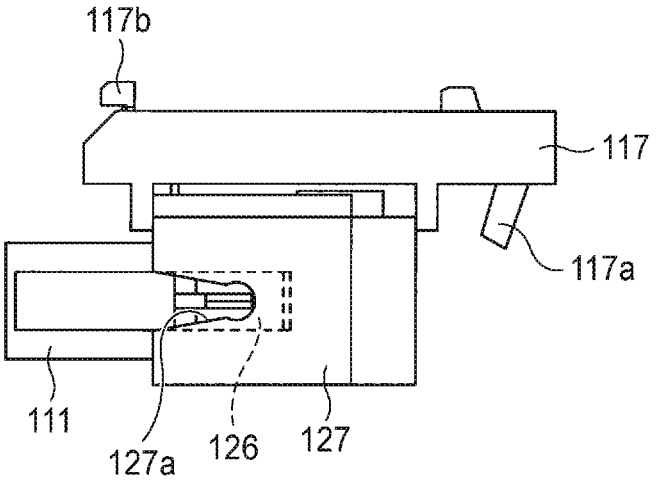
FIG. 25 is an arrow view in a 25A direction of FIG. 21.

As illustrated in FIGS. 24 and 25, in the unit base 117, an attaching piece 117*a* and a locking claw 117*b* are formed, and as illustrated in FIGS. 18 and 20, the attaching piece 117*a* is jointly fastened to the door panel 119 together with the fixing block 115*c* of the fixed handle 115, and a locking claw 117*b* is locked to a circumferential edge of the rear portion opening 119*b* of the door panel 119, are formed.

Figure 22:
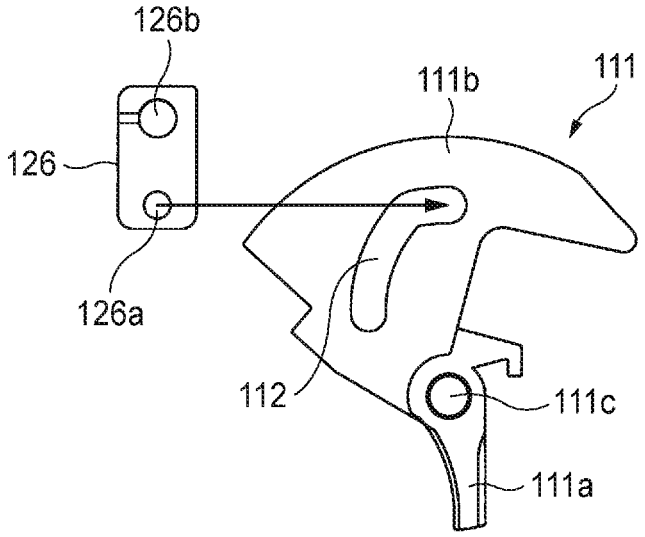
FIG. 22 is a view illustrating a linking process of a rotating body and a follower body.
Figure 23:
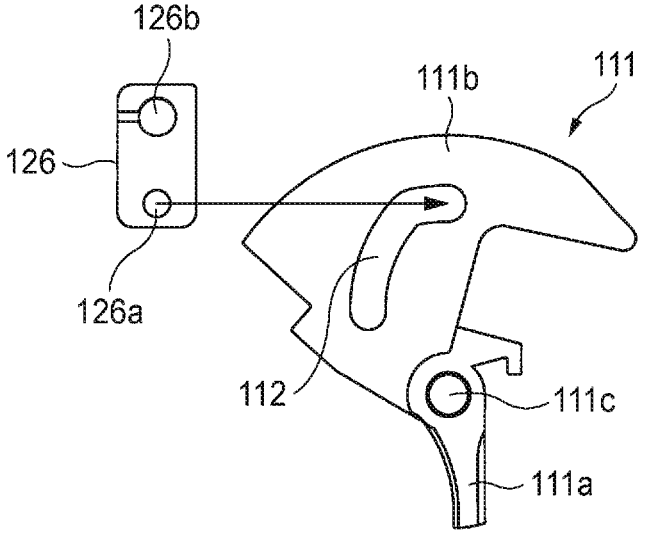
FIG. 23 is a view illustrating a state where the rotating body is attached to the linking slider.

As illustrated in FIGS. 22 and 23, the rotating body 111 includes a rod-like input portion 111*a* at one end, and 102 blade pieces 111*b* which oppose the other end, and includes a rotation shaft insertion through-hole 111*c* installed to be open in the intermediate portion. In each of the blade pieces 111*b*, a long hole-like cam portion 112 having a width dimension by which a follower pin 125 of the follower body 113 which will be described later can be inserted to be freely movable is formed.

Figure 26:
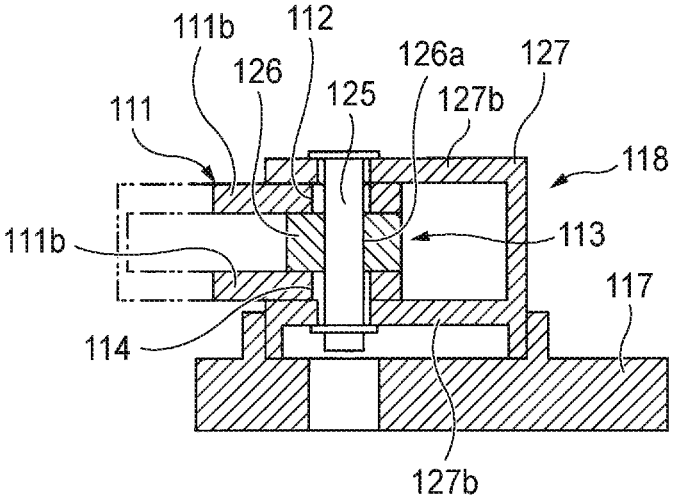
FIG. 26 is a sectional view taken along line 26A-26A of FIG. 21.

As illustrated in FIG. 23, the follower body 113 is configured to include a linking slider 126 that includes a pin stator 126*a* at one end and a wire linking hole 126*b* for linking an inner wire of a cable device that functions as an operating force transmission member 102 at the other end, and is formed in a rectangular shape (refer to FIG. 22), and the follower pin 125, and as illustrated in FIG. 26, after being fitted such that the linking slider 126 is nipped between the blade pieces 111*b* of the rotating body 111, the rotating body 111 is linked by fixing the follower pin 125 to pass the cam portion 112 and the pin stator 126*a*.

As illustrated in FIG. 24, after being mounted on a slide guide 127, the rotating body 111 which links the follower body 113 as described above is linked to the unit base 117 by a linking pin 128 which penetrates the rotation shaft insertion through-hole 111*c* and a cam attaching hole 117*c* formed in the unit base 117 (refer to FIG. 21).

In addition, as illustrated in FIG. 25, in the slide guide 127, a cable linking recess portion 127*a* for linking an outer cable of the cable device 102 linked to the linking slider 126, is formed.

The slide guide 127 is formed to open the long hole-like guide portion 114 into which the above-described follower pin 125 can be inserted, in one pair of blade pieces 127*b* that nip the rotating body 111 therebetween, and the rotating body 111 is incorporated by allowing the follower pin 125 to pass through from an opening end of the guide portion 114, and in this state, the rotating body 111 is guided in a sliding direction of the follower body 113.

In the above-described unit of the linking portion 107, the rotating body 111 is held at the initial position illustrated in FIG. 21 by a spring which is not illustrated, the output portion 123*b* of the lever 123 is fitted to the input portion 111*a* of the rotating body 111 in accordance with the linking operation of the handle unit 116 and the unit base 117 (refer to FIG. 18). In this state, when rotating the operating member 104 from the initial position to the emergency corresponding position, the lever 123 rotates to the rotation finishing end position, and according to this, the rotating body 111 rotates from the initial rotation position illustrated in FIG. 21 to the rotation finishing end position illustrated in FIG. 27C, and as a result, the linking slider 126 slides, and the door latch device 103 is operated via the cable device 102 (refer to FIG. 16).

In addition, on the unit base 117, the switch member 106 is fixed while an actuator portion 105 is oriented toward the center of the rotating body 111. As illustrated in FIG. 24, in order to fix the switch member 106, a switch fixing plate 129 is fixed to the unit base 117, and the switch member 106 is fixed to the switch fixing plate 129 in a state of being nipped by the switch fixing plate 129 and a switch cover 130 fixed to the switch fixing plate 129.

Figure 16:
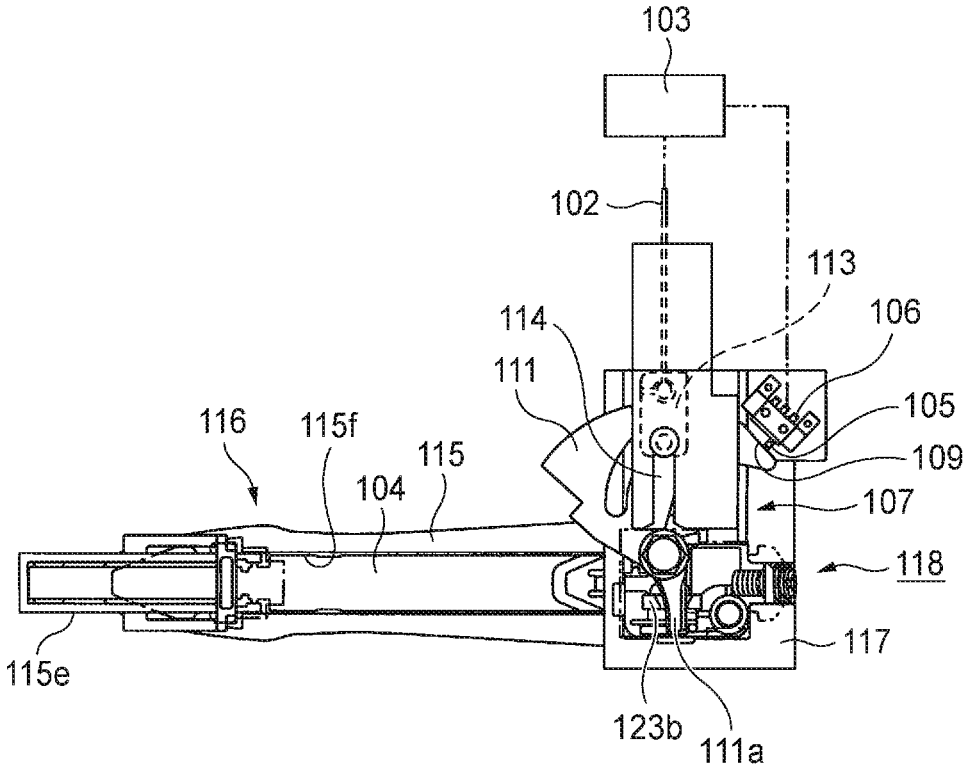
FIG. 16 is a rear view illustrating the handle device.

The output of the switch member 106 is connected to a latch control circuit which is not illustrated, and when the actuator portion 105 is pushed down, as illustrated in FIG. 16, an electric actuator, such as a motor, incorporated into the door latch device 103 is driven, and the latch releasing operation is performed.

Figure 27A:
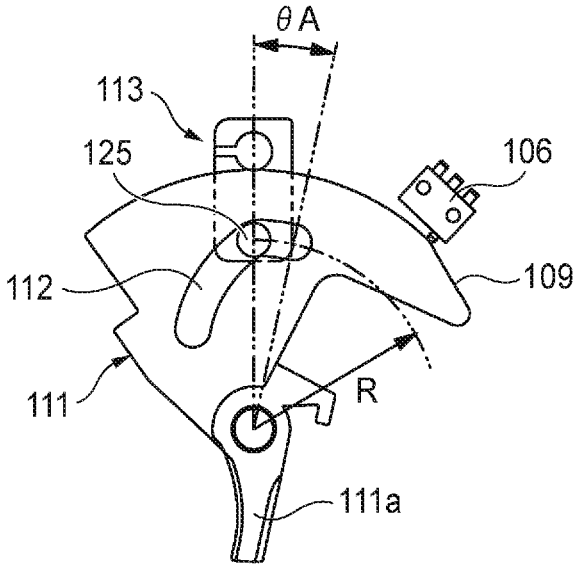
FIGS. 27A to 27C are views illustrating an operation of the rotating body.
Figure 27B:
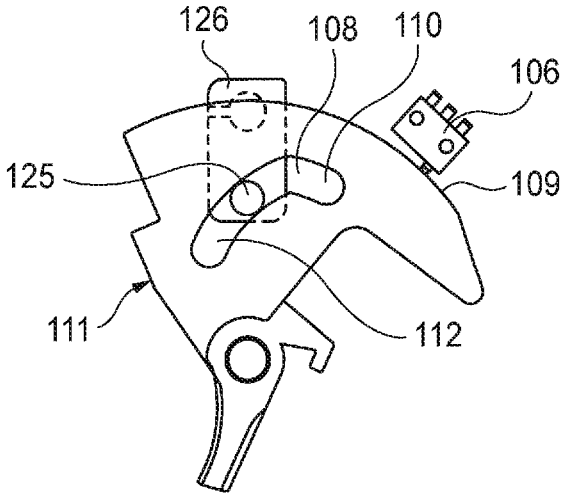
Figure 27C:
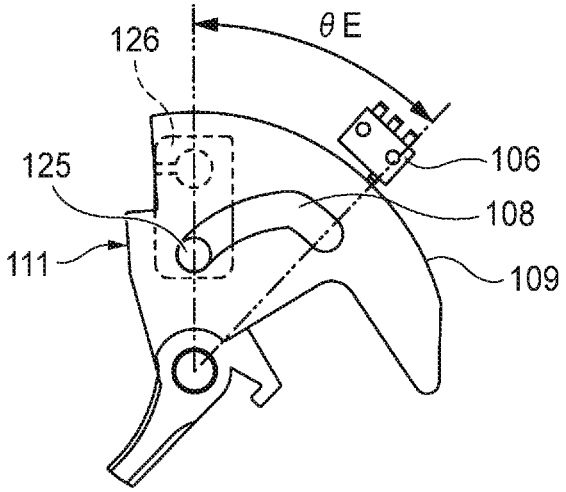

As illustrated in FIGS. 27A to 27C, a pushing portion 109 which pushes down the actuator portion 105 of the switch member 106 is formed in an outer circumferential portion of the rotating body 111. As illustrated in FIG. 27A, the pushing portion 109 finishes a pushing-down operation of the actuator portion 105 when rotating the rotating body 111 from the initial rotation position to a near operation rotation position (θA) that reaches a rotation finishing end position (θE), and after this, the pushing portion 109 is formed by a cam surface having an outline of which the pushing-down dimension is invariable by forming an arc around the rotation center of the rotating body 111.

Figure 28A:
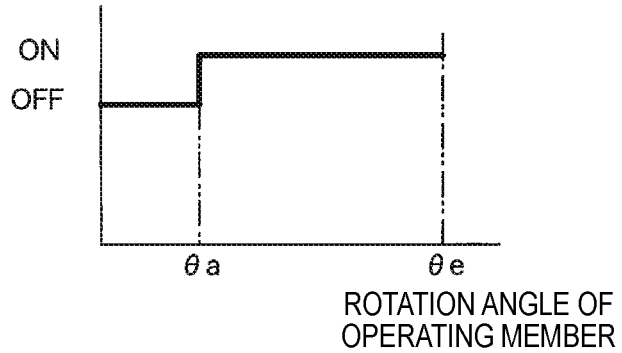
FIGS. 28A to 28C are graphs illustrating operation characteristics of an operating member.

The operation rotation position (θA) of the rotating body 111 corresponds to an operation position of the operating member 104, and as a result, as illustrated in FIG. 28A, when performing the rotation operation with respect to the operating member 104 from the initial position to the operation position (θa), the switch member 106 is pushed down and the switch is placed in a contact state.

Next, an operation of the cam portion 112 of the rotating body 111 will be described based on FIGS. 27A to 27C, 28B, and 28C. First, as described above, when performing the rotation operation with respect to the operating member 104 from the initial position to the emergency corresponding position (θe) in a state where the handle device is attached to the door 101, a ratio of the lever 123 between a transmission side and a transmitted side between the operating member 104 and the lever 123 and between the lever 123 and the rotating body 111 is substantially constant in the entire operation process of the operating member 104.

Figure 28B:
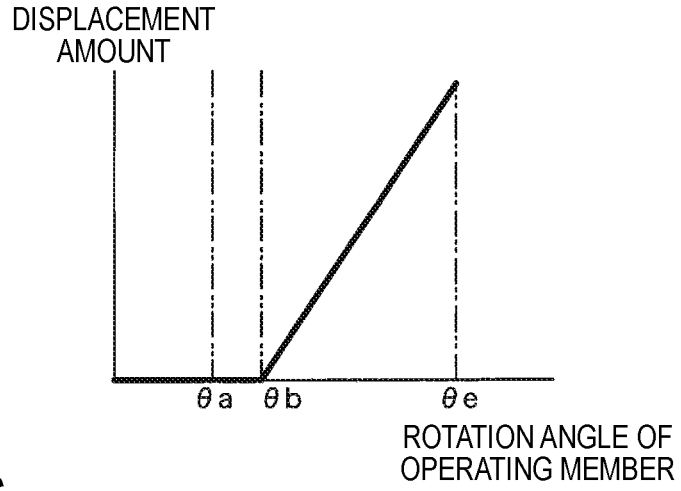

Therefore, ratios between an operation angle with respect to the operating member 104 and an operation angle of the rotating body 111 substantially match each other in the entire operation process, a relationship of the rotation of the above-described rotating body 111 and displacement of the follower body 113 substantially matches a relationship of the operation angle with respect to the operating member 104 and the displacement of the follower body 113, and the graph illustrating a relationship between the rotation angle of the operating member 104 and the displacement amount of the follower body 113 in FIG. 28B is substantially equivalent to a cam curve of the cam portion 112.

Here, with reference to FIG. 27A, a range from the initial rotation position of the cam portion 112 to the operation rotation position (θA) is formed by an arc-like long hole having a radius R around the rotation center of the rotating body 111, and in the range, the rotation of the rotating body 111, that is, the operation from the initial position of the operating member 104 to the operation position (rotation angle θa) does not cause displacement of the follower body 113 as illustrated in FIG. 28B.

In this manner, since a displacement suppression portion 110 in which the follower body 113 does not follow the rotation of the rotating body 111 in a range of the cam portion 112 from the initial rotation position to the operation rotation position (θA) is provided, the rotation operation from the initial position to the operation position of the operating member 104 only generates a disconnection operation of the switch member 106 and does not drive the follower body 113, that is, does not operate the cable device 102 at all, and thus, there is no negative influence even in a case where there is not a play in the door latch device 103.

Figure 28C:
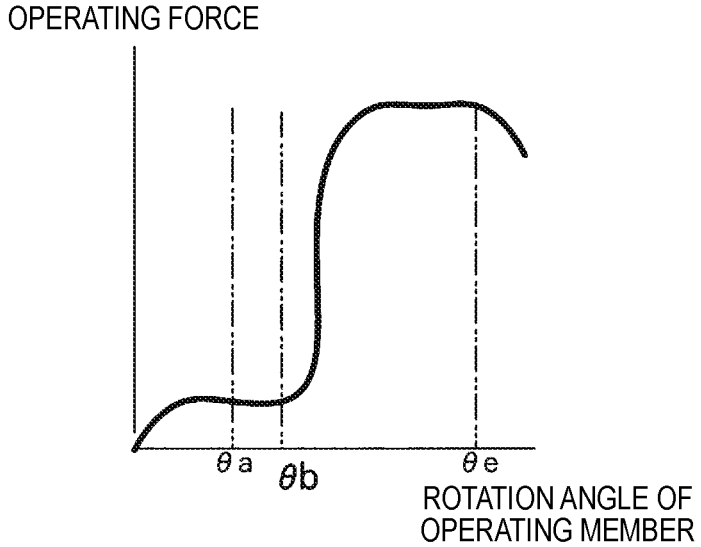

In addition, in the displacement suppression portion 110, since the resistance from the follower body 113 does not act, the operating force of the operating member 104 is equivalent to the biasing force to the rotating body 111 or the operating member 104, and is substantially constant as illustrated in FIG. 28C.

After this, the cam portion 112 is formed to have an outline curve which approaches the rotation center of the rotating body 111 as approaching the rotation finishing end position (θE). The cam curve illustrated by a curve of the outline can be expressed by a straight line in which the displacement amount of the follower body 113 increases as the operation angle increases as illustrated in FIG. 28B, and the line of the operating force also becomes a substantially constant value as illustrated in FIG. 28C.

At this time, in FIG. 28B, in the vicinity of a boundary portion in which the displacement amount linearly increases from 100 (rotation angle θb), by generation or the like of acceleration caused by a decrease in a component of a force in the moving direction of the follower body 113 by the rotating force of the rotating body 111 due to the change in an abut state between the follower pin 125 of the follower body 113 and the wall surface of the cam portion 112, an inertia when starting the movement from a still state, or a sudden change in moving speed of the follower body 113, as illustrated in FIG. 28C, a phenomenon of a rapid increase in operating force is generated.

By appropriately setting the operating force at this time, an increase start portion of the operating force formed by the cam portion 112 is a resistance applying portion 108, and it becomes possible to recognize a start position and the vicinity of the operation position of the increase range as a rotation finishing end of the operating member 104, with respect to the user of the operating member 104.

In addition, in FIG. 28B, a case where the displacement of the operating member 104 is adjusted to linearly increase with respect to the operation angle within the range that exceeds the operation position (θa) is illustrated, but a graph of the operation angle and the displacement within the range may be an appropriate right-upward graph in addition to a straight line.

In addition, in the example, the resistance applying portion 108 is formed by suddenly increasing the operating force, but a smooth increase within a range in which the user can recognize the rotation finishing end may be employed.

Therefore, in the example, in a normal state, the user can operate the operating member 104 as an operating range from the initial position to the operation position, and can perform the latch releasing operation in which the electric actuator is used by an inputting operation into the switch member 106 by the operation.

In addition, in a state where the latch releasing operation in which the electric actuator is used is not appropriately performed, when performing the rotation operation with respect to the operating member 104 further to emergency corresponding position at an operating force which is against the resistance applied by the resistance applying portion 108, it is possible to operate the cable device 102 via the follower body 113, and to perform the latch releasing of the door latch device 103.

In addition, above, a handle device in which the operating member 104 is linked to the fixed handle 115 in advance and which is fixed to the door 101 is described, but, the invention can also be employed in a handle device in which the base 115 is fixed to the rear surface of the door panel 119 in advance and the movable handle that provides a handle when performing the opening operation with respect to the door 101 is mounted on the base 115 from the front surface side of the door 101 as the operating member 104.

(Additional Description)

(Additional Description 1)

A handle device for a vehicle which is fixed to the door 101 of a vehicle, and remotely operates the door latch device 103 that can perform a latch releasing operation by the operating force transmission member 102 in addition to a latch releasing operation by an electric actuator, the device including: the operating member 104 which is to be rotatably operable in a direction that matches an opening operation direction of the door 101 until reaching an emergency corresponding position via an operation position from an initial position, and which becomes a handle when performing the opening operation with respect to the door 101; the switch member 106 which transitions an operation circuit with respect to the electric actuator to be in a contact state as the actuator portion 105 is pushed in accordance with a rotation operation to an operation position of the operating member 104; the linking portion 107 which moves the operating force transmission member 102 to the operation position in accordance with the movement to the emergency corresponding position of the operating member 104; and the resistance applying portion 108 which holds the operating member 104 at the operation position by a predetermined holding force.

(Additional Description 2)

The handle device for the vehicle according to Additional Description 1, in which the pushing portion 109 with respect to the actuator portion 105 of the switch member 106 is formed by a cam surface of which a pushing-in dimension until reaching the emergency corresponding position is invariable, after finishing the pushing of the switch member 106 by the rotation to the operation position of the operating member 104.

(Additional Description 3)

The handle device for the vehicle according to Additional Description 1 or 2, in which the linking portion 107 includes the displacement suppression portion 110 which suppresses displacement that occurs in accordance with the rotation operation to the operation position from the initial position of the operating member 104, and regulates transmission of an operating force to the operating force transmission member 102.

(Additional Description 4)

The handle device for the vehicle according to Additional Description 1, in which the linking portion 107 includes the rotating body 111 which is driven to rotate by the operating member 104, the follower body 113 which is driven by the cam portion 112 formed in the rotating body 111 and of which one end is linked to the operating force transmission member 102, and the guide portion 114 which regulates a moving direction of the follower body 113.

(Additional Description 5)

The handle device for the vehicle according to Additional Description 4, in which the pushing portion 109 with respect to the actuator portion 105 of the switch member 106 is formed at an outer circumference of the rotating body 111.

(Additional Description 6)

The handle device for the vehicle according to Additional Description 4 or 5, in which the resistance applying portion 108 is formed by the cam portion 112 which corresponds to a steep cam curve, in a rotation angle of which an increment of a movement amount of the follower body 113 per unit operation angle of the operating member 104 exceeds the operation position.

(Additional Description 7)

The handle device for the vehicle according to any one of Additional Descriptions 2 to 5, in which, in the rotating body 111, the linking portion 107 which is disposed in the handle base 115 and can be linked to an output portion that outputs rotation displacement of the operating member 104 in a fitted shape is provided, and is linked to the unit base 117 fixed to the door panel 119, and in which, the switch member 106 is fixed to the unit base 117.

(Additional Description 8)

A handle device for a vehicle which is fixed to the door 101 of a vehicle, and remotely operates the door latch device 103 that can perform a latch releasing operation by the operating force transmission member 102 in addition to a latch releasing operation by an electric actuator, the device including: the operating member 104 which is freely movable until reaching an emergency corresponding position via an operation position from an initial position; the switch member 106 which transitions an operation circuit with respect to the electric actuator to be in a contact state as an actuator portion 105 is pushed in accordance with a rotation operation to an operation position of the operating member 104; and the linking portion 107 which includes the rotating body 111 driven to rotate by the operating member 104, the follower body 113 which is driven by the cam portion 112 formed in the rotating body 111 and of which one end is linked to the operating force transmission member 102, and the guide portion 114 which regulates the moving direction of the follower body 113, and which moves the operating force transmission member 102 to the operation position in accordance with the movement of the operating member 104 to the emergency corresponding position, and in which, by allowing the cam portion 112 of the rotating body 111 to correspond to a steep cam curve in a rotation angle in which an increment of a movement amount of a slider per unit operation angle of the operating member 104 exceeds an operation position, a predetermined resistance force is applied to a separation operation to the emergency corresponding position side from the operation position of the operating member 104.

Priority is claimed on Japanese Patent Application No. 2015-049643, filed on Mar. 12, 2015, the content of which is incorporated herein by reference.

REFERENCE SIGNS LIST

1 DOOR
2 BASE (FIXED HANDLE)
3 OPERATING MEMBER (MOVABLE HANDLE)
4 OUTPUT PORTION
5 DOOR LOCK DEVICE
6 CAM PORTION
7 CAM BODY
8 FOLLOWER BODY (LINKING SLIDER)
9 FOLLOWER PIN
10 HANDLE UNIT
11 UNIT BASE
12 OUTPUT PORTION UNIT
13 LINKED PORTION
14 LEVER
15 LINKING PORTION
101 DOOR
102 OPERATING FORCE TRANSMISSION MEMBER
103 DOOR LATCH DEVICE
104 OPERATING MEMBER
105 ACTUATOR PORTION
106 SWITCH MEMBER
107 LINKING PORTION
108 RESISTANCE APPLYING PORTION
109 PUSHING PORTION
110 DISPLACEMENT SUPPRESSION PORTION
111 ROTATING BODY
112 CAM PORTION
113 FOLLOWER BODY
114 GUIDE PORTION
115 BASE
116 HANDLE UNIT
117 UNIT BASE
118 LINKING UNIT
119 DOOR PANEL

What is claimed is:

1. A handle device for a vehicle in which an operating member linked to a base fixed to a door of a vehicle to be rotatably operable is operated so as to displace an output portion and operate a door lock device in the door linked to the output portion, wherein the output portion includes a cam body including a curved cam portion which is linked to the base, driven to rotate by the operating member, and for determining a rotation angle of the operating member and a property of displacement of the output portion, wherein a displacement amount in the output portion per unit operation angle of the operating member increases or decreases according to a rotation position of the operating member, and wherein, when the operating member is operated, an operating force of the operating member is reduced.

2. The handle device for the vehicle according to claim 1, wherein the output portion further includes a follower body driven by the curved cam portion, and wherein the door lock device is operated by the displacement of the follower body.

3. The handle device for the vehicle according to claim 2, wherein the cam body having a shape of a plate lever includes a long hole which is opened and in which a distance from a rotation center of the cam body gradually changes, and wherein a follower pin, which moves in the long hole, is provided in the follower body.

4. The handle device for the vehicle according to claim 1, further comprising:

a handle unit which links the operating member and the base to each other in advance and is fixed to a front surface of the door;

a unit base which is fixed to a rear surface of the door panel; and an output portion unit which holds the output portion to the unit base and is fixed to the rear surface of the door panel.

5. The handle device for the vehicle according to claim 4, wherein a lever which swings in accordance with the operation of the operating member and in which a linked portion is oriented toward the inside of the door, is disposed in the handle unit, and wherein a linking portion which is linked to the linked portion of the lever and transmits an operating force toward the operating member to the output portion when being fixed to the rear surface of the door panel, is provided with the output portion unit.

6. A handle device for a vehicle which is fixed to a door of a vehicle, and remotely operates a door latch device which performs a latch releasing operation by an electric actuator and a latch releasing operation by an operating force transmission member, the device comprising:

an operating member which is rotatably operable in a direction that matches an opening operation direction of the door until reaching an emergency corresponding position via an operation position from an initial position, and which becomes a handle when performing the opening operation with respect to the door;

a switch member which transitions an operation circuit to be in a contact state with respect to the electric actuator as an actuator portion is pushed in accordance with a rotation operation to the operation position of the operating member;

a linking portion which moves the operating force transmission member to the operation position in accordance with the movement to the emergency corresponding position of the operating member, wherein the linking portion includes a rotating body, having a curved cam portion formed therein, which is driven to rotate by the operating member; and a resistance applying portion which holds the operating member at the operation position by a predetermined holding force, wherein, when the operating member is operated, an operating force of the operating member is increased.

7. The handle device for the vehicle according to claim 6, wherein a pushing portion with respect to the electric actuator portion of the switch member includes a cam surface in which a pushing-in dimension is invariable after finishing pushing of the actuator portion by the rotation to the operation position of the operating member until reaching the emergency corresponding position.

8. The handle device for the vehicle according to claim 6, wherein the linking portion includes a displacement suppression portion which suppresses displacement that occurs in accordance with the rotation operation to the operation position from the initial position of the operating member, and regulates transmission of an operating force to the operating force transmission member.

9. The handle device for the vehicle according to claim 6, wherein the linking portion further includes a follower body which is driven by the curved cam portion formed in the rotating body, and in which one end thereof is linked to the operating force transmission member, and a guide portion which regulates a moving direction of the follower body.

10. The handle device for the vehicle according to claim 9, wherein the pushing portion with respect to the electric actuator portion of the switch member is formed at an outer circumference of the rotating body.

11. The handle device for the vehicle according to claim 9, wherein the resistance applying portion is formed by a cam portion which corresponds to a steep cam curve in a rotation angle in which a movement amount of the follower body increases as an operation angle of the operating member exceeds the operation position.

12. The handle device for the vehicle according to claim 6, further comprising:

a handle unit in which the operating member is linked to a base fixed to a front surface of a door panel; and a linking unit in which the linking portion and the switch member are linked to a unit base fixed to a rear surface of the door panel.

13. The handle device for the vehicle according to claim 1, wherein the door lock device is connected to the output portion via a cable device.

14. The handle device for the vehicle according to claim 6, wherein the operating force transmission member is a cable device.

15. The handle device for the vehicle according to claim 1, wherein the cam portion is a first long hole in which a distance from a rotation center of the cam body to the first long hole increases or decreases over a longitudinal direction of the first long hole, the first long hole being opened in the cam body.

16. The handle device for the vehicle according to claim 15, wherein a first distance between the rotation center of the cam body and a first end of the first long hole in the longitudinal direction of the first long hole is different from a second distance between the rotation center of the cam body and a second end of the first long hole in the longitudinal direction, the second end being opposite end of the first long hole to the first end.

17. The handle device for the vehicle according to claim 6, wherein the resistance applying portion is formed by a cam portion being a second long hole in which a distance from a rotation center of the rotating body to the second long hole increases or decreases over a longitudinal direction of the second long hole, the second long hole being opened in the rotating body.

18. The handle device for the vehicle according to claim 17, wherein a third distance between the rotation center of the rotating body and a third end of the second long hole in the longitudinal direction of the second long hole is different from a fourth distance between the rotation center of the rotating body and a fourth end of the second long hole in the longitudinal direction, the fourth end being opposite end of the second long hole to the third end.

19. The handle device for the vehicle according to claim 18, wherein the third distance is greater than the fourth distance.

20. The handle device for the vehicle according to claim 1, wherein the displacement amount in the output portion per unit operation angle of the operating member at an initial state of a handle operation is greater than the displacement amount in the output portion per unit operation angle of the operating member in a vicinity of a lock releasing operation position of the door lock device.

* * * * *